US010584712B2

(12) United States Patent
Ishikawa et al.

(10) Patent No.: US 10,584,712 B2
(45) Date of Patent: Mar. 10, 2020

(54) IMPELLER

(71) Applicant: HONDA MOTOR CO., LTD., Tokyo (JP)

(72) Inventors: Hiroshi Ishikawa, Tochigi (JP); Shinzo Urushidani, Tochigi (JP); Yoshinori Tsurugai, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 616 days.

(21) Appl. No.: 15/108,135

(22) PCT Filed: Dec. 26, 2014

(86) PCT No.: PCT/JP2014/084636

§ 371 (c)(1),
(2) Date: Jun. 24, 2016

(87) PCT Pub. No.: WO2015/099155

PCT Pub. Date: Jul. 2, 2015

(65) Prior Publication Data

US 2016/0341210 A1 Nov. 24, 2016

(30) Foreign Application Priority Data

Dec. 27, 2013 (JP) ..... 2013-271930
Mar. 31, 2014 (JP) ..... 2014-074396
Mar. 31, 2014 (JP) ..... 2014-074397

(51) Int. Cl.
*F04D 29/22* (2006.01)
*F04D 29/28* (2006.01)
(Continued)

(52) U.S. Cl.
CPC ..... *F04D 29/2261* (2013.01); *F04D 29/023* (2013.01); *F04D 29/026* (2013.01);
(Continued)

(58) Field of Classification Search
CPC ..... F04D 29/023; F04D 29/026; F04D 29/08; F04D 29/2261; F04D 29/42; F04D 29/4206; F04D 29/4226; F04D 29/4233
(Continued)

(56) References Cited

U.S. PATENT DOCUMENTS 3,225,422 A * 12/1965 Sebok ..... B21D 53/267 29/463
4,120,084 A * 10/1978 Wallman ..... B21D 39/03 29/509
(Continued)

FOREIGN PATENT DOCUMENTS

CN 1300350 A 6/2001
CN 102959249 A 3/2013
(Continued)

OTHER PUBLICATIONS

International Search Report, dated Mar. 31, 2015 (dated Mar. 31, 2015).
(Continued)

*Primary Examiner* — Dwayne J White
*Assistant Examiner* — Aye S Htay
(74) *Attorney, Agent, or Firm* — Rankin, Hill & Clark LLP

(57) ABSTRACT

An impeller in which blades and a shroud are bonded in a stable manner. The impeller is provided with a plurality of blades disposed on a base, and a shroud disposed facing the base across the blades. The shroud has a curved shape, wherein the shroud has a flat part in the outer periphery, protuberances are provided to flat surfaces of the blades, through-holes are provided to the flat part of the shroud, and, after the protuberances are inserted through the through-holes, the flat surfaces of the blades and the flat part of the shroud are bonded together by deforming the tips of the protuberances into thermally caulked parts larger in diameter than the opening diameters of the through-holes.

1 Claim, 25 Drawing Sheets

(51) Int. Cl.

| | |
|---|---|
| ***F04D 29/62*** | (2006.01) |
| ***F04D 29/02*** | (2006.01) |
| ***F04D 29/08*** | (2006.01) |

(52) U.S. Cl.
CPC ..... *F04D 29/08* (2013.01); *F04D 29/2227* (2013.01); *F04D 29/284* (2013.01); *F04D 29/624* (2013.01); *F04D 29/628* (2013.01); *F05D 2230/23* (2013.01); *F05D 2260/36* (2013.01); *F05D 2300/43* (2013.01)

(58) Field of Classification Search
USPC ..... 416/186 R; 417/423.14
See application file for complete search history.

(56) References Cited

U.S. PATENT DOCUMENTS

| | | | | |
|---|---|---|---|---|
| 5,328,332 | A | 7/1994 | Chiang | |
| 6,386,831 | B1 * | 5/2002 | Stahl | F04D 29/281 29/889.21 |
| 6,592,329 | B1 * | 7/2003 | Hirose | F04D 29/023 416/203 |
| 2011/0200439 | A1 | 8/2011 | Nakaniwa et al. | |
| 2013/0071247 | A1 | 3/2013 | Ishiguro et al. | |

FOREIGN PATENT DOCUMENTS

| | | |
|---|---|---|
| EP | 2 441 962 A1 | 4/2012 |
| JP | 2002-054594 | 2/2002 |
| JP | 2002-098091 | 4/2002 |
| JP | 2004-308647 | 11/2004 |
| JP | 3805609 | 8/2006 |
| JP | 2009-257132 | 11/2009 |
| JP | 2010-059876 | 3/2010 |
| JP | 2010-121612 | 6/2010 |
| JP | 2010-236495 | 10/2010 |
| JP | 2012-12937 | 1/2012 |
| JP | 2013-213443 | 10/2013 |

OTHER PUBLICATIONS

Chinese Office Action dated Aug. 31, 2017, 6 pages.
Chinese Office Action dated Jan. 6, 2020, 8 pages.

* cited by examiner

IMPELLER

TECHNICAL FIELD

The present invention relates to impellers. More specifically, the present invention relates to an impeller that stably joins a blade and a shroud.

BACKGROUND ART

Conventionally, a technology is disclosed in which a blade where a sharp-pointed protrusion whose upper end is smaller in width than the tip end surface of the blade and whose angle is acute is integrally formed and where a relief groove portion is formed at an intermediate place in the tip end surface on a front side of the blade in a rotation direction is provided and in which the sharp-pointed protrusion is melted to weld a front plate (shroud) to the blade (see Patent Document 1).

It is thought that in the technology of Patent Document 1, the relief groove portion is provided to prevent the production of flash caused by the welding, and the flash caused by the welding in the entire blade can be completely removed at the time of completion, with the result that it is possible to enhance productivity (manufacturing efficiency) and product quality.

A technology is also disclosed in which a shroud and a blade opposite the shroud are joined with a joint portion which is formed with a horizontal flat portion provided in the rear edge portion and the front edge portion of the blade or the center portion thereof and an inclined flat portion provided between the horizontal flat portions (see Patent Document 2).

It is thought that in the technology of Patent Document 2, the shroud and the blade are joined with the horizontal flat portion and the inclined flat portion, and when they make contact with each other, it is possible to accurately achieve close contact without any gap, with the result that this part is accurately welded by high-frequency waves to acquire sufficient welding strength.

Patent Document 1: Japanese Unexamined Patent Application, Publication No. 2010-236495

Patent Document 2: Japanese Unexamined Patent Application, Publication No. 2009-257132

DISCLOSURE OF THE INVENTION

Problems to be Solved by the Invention

However, although the technology of Patent Document 1 is effective when the shape of the blade is simple, it is necessary to make the shroud correspond in shape to the blade when the shape of the blade is complicated. When the shape of the blade is complicate, it is necessary to highly accurately make the shroud correspond in shape to the blade, and thus the productivity is degraded. When the shroud does not correspond in shape to the blade, a clearance is produced between the shroud and the blade, and the welding becomes unsatisfactory, with the result that the joint becomes unstable.

Although in the technology of Patent Document 2, a joint part is simplified by the joint portion formed with the horizontal flat portion and the inclined flat portion, and thus the technology is effective for reducing the size of an impeller, the horizontal flat portion and the inclined flat portion are joined over the entire area, and a joint range is wide. Hence, it is necessary to highly accurately match the joint portion in the wide joint range of the shroud and the blade, and thus the productivity is degraded. When the joint portion of the shroud and the blade is not matched, a clearance is produced between the shroud and the blade, and the joint becomes unsatisfactory, with the result that the joint becomes unstable.

The present invention is made in order to solve the problem described above, and an object thereof is to provide an impeller that stably joins the blade and the shroud.

As an impeller that is attached to a water pump or the like, in the impeller as disclosed in Patent Documents 1 and 2 in which the shroud is arranged on the outer circumferential side of the blade, flow loss is low, and high efficiency is achieved but in order to enhance the strength, it is necessary to firmly fix the shroud to a blade member.

Incidentally, depending on the shape of a blade, it may be difficult to integrally mold the blade member of an impeller. In such a case, the blade member is formed with two or more members.

In an impeller whose blade member is formed with a plurality of members and which has a shroud, since it is necessary to fix members forming the blade member and to further fix the blade member and the shroud, the manufacturing process is complicated.

The present invention is made in view of the foregoing, and has an object to provide an impeller which is easily manufactured though the impeller has a shroud and its blade member is formed with a plurality of members.

In an impeller which has a shroud, as a method of joining a blade member and the shroud, a method of welding them by ultrasound or heat and the like are included. However, when the blade member and the shroud are joined with these methods, though the impeller has high strength, the manufacturing of the impeller is complicated, with the result that the manufacturing cost is increased.

The present invention is made in view of the foregoing, and has an object to provide an impeller whose strength is sufficiently high, which is easily manufactured and which has a shroud.

Means for Solving the Problems (1) An impeller including: a plurality of blades (for example, blades 23 which will be described later) which are arranged on a main plate (for example, a base 21 which will be described later); and a shroud (for example, a shroud 3 which will be described later) which is arranged through the blade opposite the main plate and which has a curved shape, where the shroud includes a flat portion (for example, a flat portion 33 which will be described later) on an outer circumferential portion, and an outer circumferential end portion (for example, a flat surface 24 which will be described later) of the blade and the flat portion of the shroud are joined.

In the invention of (1), the outer circumferential end portion of the blade and the flat portion of the shroud are joined.

As described above, the outer circumferential end portion of the blade and the flat portion of the shroud are only joined, and thus the outer circumferential end portion and the flat portion have simple shapes and form a narrow joint range. Hence, high accuracy is not required for making the outer circumferential end portion of the blade and the flat portion of the shroud coincide with each other in the narrow joint range, and thus the productivity is satisfactory. Moreover, the outer circumferential end portion of the blade and the flat portion of the shroud can be easily made to coincide with each other, no clearance is produced between the outer circumferential end portion of the blade and the flat portion of the shroud and the joint is formed firmly. Thus, it is possible to stably join the blade and the shroud.

(2) The impeller according to (1), where a protrusion (for example, a protrusion 25 which will be described later) is provided on the outer circumferential end portion of the blade, a through hole (for example, a through hole 34 which will be described later) is provided in the flat portion of the shroud and the protrusion is inserted through the through hole and then a tip end (for example, a heat crimp portion 26 which will be described later) of the protrusion is deformed to have a larger diameter than an opening diameter (for example, an opening diameter O2 which will be described later) of the through hole such that the outer circumferential end portion of the blade and the flat portion of the shroud are joined.

In the invention of (2), the protrusion is inserted through the through hole, and thereafter the tip end of the protrusion is deformed to have a larger diameter than the opening diameter of the through hole, with the result that the outer circumferential end portion of the blade and the flat portion of the shroud are joined.

Since as described above, the protrusion is inserted through the through hole, and thereafter the tip end of the protrusion is deformed to have a larger diameter than the opening diameter of the through hole, the deformed tip end of the protrusion is locked to the through hole, and thus it is possible to firmly join, only at the place of the protrusion, the outer circumferential end portion of the blade and the flat portion 33 of the shroud.

(3) The impeller according to (2), where in the flat portion of the shroud, a concave portion (for example, a concave portion 35 which will be described later) surrounding the through hole is provided.

In the invention of (3), in the flat portion of the shroud, the concave portion surrounding the through hole is provided.

As described above, in the flat portion of the shroud, the concave portion surrounding the through hole is provided, and thus the tip end of the protrusion deformed to have a larger diameter than the opening diameter of the through hole can be surrounded by the concave portion. Hence, the deformed tip end of the protrusion can be held within the concave portion, and the deformed tip end of the protrusion does not inhibit the flow of the fluid passing through the impeller, with the result that it is possible to enhance the performance of the impeller.

(4) The impeller according to (3), where a direction of a width (for example, a longitudinal width 25*a* which will be described later) of the protrusion is inclined with respect to a direction of a circumference along a curve of the blade extended out, a direction of a width (for example, a longitudinal width 35*a* which will be described later) of the concave portion coincides with the direction of the circumference and the protrusion is inserted through the through hole and then the tip end of the protrusion is deformed such that a direction of a width of the tip end of the protrusion coincides with the direction of the circumference.

In the invention of 4), the protrusion is inserted through the through hole, and thereafter the tip end of the protrusion is deformed such that the direction of the width of the tip end of the protrusion coincides with the circumferential direction.

Since as described above, the protrusion is inserted through the through hole, and thereafter the direction of the width of the protrusion is deformed such that the direction of the width of the tip end of the protrusion coincides with the circumferential direction, even when the flat portion of the shroud is narrow, it is possible to acquire such a large contact area that the deformed tip end of the protrusion is locked to the through hole. Hence, the deformed tip end of the protrusion is reliably locked to the through hole, and thus it is possible to firmly join, at the place of the protrusion, the outer circumferential portion of the blade and the flat portion of the shroud.

(5) An impeller including: a blade member (for example, a blade member 62, 62A, 62B, 62C which will be described later) which includes a base (for example, base 621, 621A, 621B, 621C which will be described later) and a plurality of blades (for example, blades 622, 622A, 622B, 622C which will be described later) arranged on the base; and a cylindrical shroud (for example, a shroud 63, 63A, 63B, 63C which will be described later) which is arranged through the blade opposite the base and which covers the blade, where the blade member includes a first blade member (for example, a first blade member 623, 623A, 623B, 623C which will be described later) which is arranged on a side of the shroud and which forms a part of the blade and a second blade member (for example, a second blade member 624, 624A, 624B, 624C which will be described later) which is fixed to the shroud, which sandwiches the first blade member together with the shroud and which forms at least a part of another portion of the blade.

In the invention of (5), in the impeller which includes the shroud and in which the blade member includes the first blade member and the second blade member, the second blade member sandwiches the first blade member together with the shroud.

In this way, it is not necessary to join the first blade member and the second blade member. Thus, it is possible to easily manufacture the impeller.

(6) The impeller according to (5), where the first blade member includes a protrusion portion (for example, a protrusion portion 6234, 6234A which will be described later) which is protruded to the side of the shroud, and the shroud includes a concave portion (for example, a concave portion 634, 634A which will be described later) which is formed therewithin and with which the protrusion portion is engaged.

In the invention of (6), the first blade member includes the protrusion portion in which the first blade member is protruded to the side of the shroud, and the shroud includes the concave portion. Furthermore, the protrusion portion is engaged with the concave portion.

In this way, when the impeller is manufactured, it is possible to easily locate the first blade member. The second blade member and the shroud can more stably sandwich the first blade member.

(7) The impeller according to (6), where the protrusion portion is formed in a shape of a ring.

In the invention of (7), the protrusion portion 234 is formed in the shape of a ring.

In this way, when the impeller is manufactured, it is possible to easily locate the first blade member.

(8) The impeller according to any one of (5) to (7), where the shroud includes a flange portion (for example, a flange portion 632, 632A, 632B, 632C which will be described later) which is formed on a circumferential edge of an end portion on a side of the base and in which a surface on the side of the base is formed in a shape of a flat surface, and the second blade member includes a flat portion which is in surface contact with the flange portion.

In the invention of (8), the shroud is formed on the circumferential edge of an end portion on the side of the base, and the surface on the side of the base includes the flange portion formed in the shape of a flat surface. The second blade member includes the flat portion which is in surface contact with the flange portion.

In this way, when the impeller is manufactured, the surface on the side of the base of the flange portion and the flat portion are brought into contact with each other, and thus it is possible to easily locate the second blade member.

(9) The impeller according to (5), where the first blade member includes a first engagement portion (for example, a first engagement portion 6235B, 6235C which will be described later) which is formed on the side of the shroud, the second blade member includes a second engagement portion (for example, a second engagement portion 6243B, 6243C which will be described later) which is formed on the side of the shroud and the shroud includes an engaged portion (for example, an engaged portion 633B, 633C which will be described later) with which the first engagement portion and the second engagement portion are engaged.

In the invention of (9), the first blade member and the second blade member respectively have the first engagement portion and the second engagement portion formed on the side of the shroud, and the shroud has the engaged portion 633B with which the first engagement portion and the second engagement portion are engaged.

In this way, when the impeller is manufactured, it is possible to easily locate the shroud with respect to a blade member (the first blade member and the second blade member).

(10) The impeller according to (9), where the first engagement portion and the second engagement portion are adjacent to each other.

In the invention of (10), the first engagement portion and the second engagement portion 6243B are adjacent to each other. In this way, with one engaged portion, it is possible to integrate the three members, that is, the first blade member, the second blade member and the shroud, with the result that it is easier to manufacture the impeller 61B.

(11) An impeller including: a base (for example, a base 721 which will be described later); a plurality of blades (for example, blades 722 which will be described later) which are arranged on the base; and a cylindrical shroud (for example, a shroud 73 which will be described later) which is arranged through the blade opposite the base and which covers the blade, where between the shroud and the base, a flow path (for example, a flow path 74 which will be described later) partitioned by the blades is formed, and the shroud includes a shroud main body portion (for example, a shroud main body portion 731 which will be described later) and a connector portion (for example, a connector portion 732 which will be described later) which is extended out to a side of the base from an end portion on the side of the base of the shroud main body portion so as to straddle the flow path and which is engaged with the base.

In the invention of (11), in the impeller including the shroud, the shroud includes a plurality of connector portions which are extended to the side of the base from the end portion on the side of the base of the shroud main body portion to straddle the flow path formed between the shroud and the base and which are engaged with the base.

In this way, the connector portion is only engaged with the base, and thus it is possible to couple the shroud and the blade member, with the result that the impeller is easily manufactured. Since the connector portion straddles the flow path, the connector portion is formed so as to have a sufficient length. Hence, when the connector portion is engaged with the base, the connector portion can be curved by being elastically deformed, with the result that it is also possible to prevent the shroud from being broken.

(12) The impeller according to (11), where the connector portion is arranged on an extension line in a direction extending to an outer circumferential side of the blade.

In the invention of (12), the connector portion is arranged on the extension line in the direction extending to the outer circumferential side of the blade.

In this way, since the connector portion is prevented from interfering with the fluid passing through the impeller, the efficiency when the impeller is used is enhanced.

(13) The impeller according to (12), where a thickness of the connector portion when seen from an outer circumferential side of the connector portion is equal to or less than a thickness of the blade.

In the invention of (13), the thickness when seen from the outer circumferential side of the connector portion is equal to or less than that of the blade.

In this way, the connector portion is not extended to the flow path, and is prevented from interfering with the fluid passing through the impeller, and thus the efficiency when the impeller is used is enhanced.

(14) The impeller according to (12) or (13), where the connector portion is arranged so as to correspond to all the blades.

In the invention of (14), the connector portions are arranged so as to correspond to all the blades.

In this way, it is possible to disperse a force applied to the connector portion, with the result that the strength of the impeller is enhanced.

(15) The impeller according to any one of (11) to (14), where the connector portion includes, at a tip end, a nail portion (for example, a nail portion 7321 which will be described later) which is locked to the base.

In the invention of (15), the connector portion has, at its tip end, the nail portion which is locked to the base.

In this way, it is possible to more easily couple the shroud and the blade member. The shroud is unlikely to be removed from the blade member, and thus the strength of the impeller is more enhanced.

Effects of the Invention

In the inventions of (1) to (4), it is possible to provide the impeller that stably joins the blade and the shroud.

In the inventions of (5) to (10), it is possible to provide the impeller which is easily manufactured though the impeller has the shroud, and the blade member is formed with a plurality of members.

In the inventions of (11) to (15), it is possible to provide the impeller whose strength is sufficiently high, which is easily manufactured and which has the shroud.

PREFERRED MODE FOR CARRYING OUT THE INVENTION

Embodiments of the present invention will be described in detail below with reference to drawings.

First Embodiment

The configuration of an impeller 1 will first be described.

Figure 1:
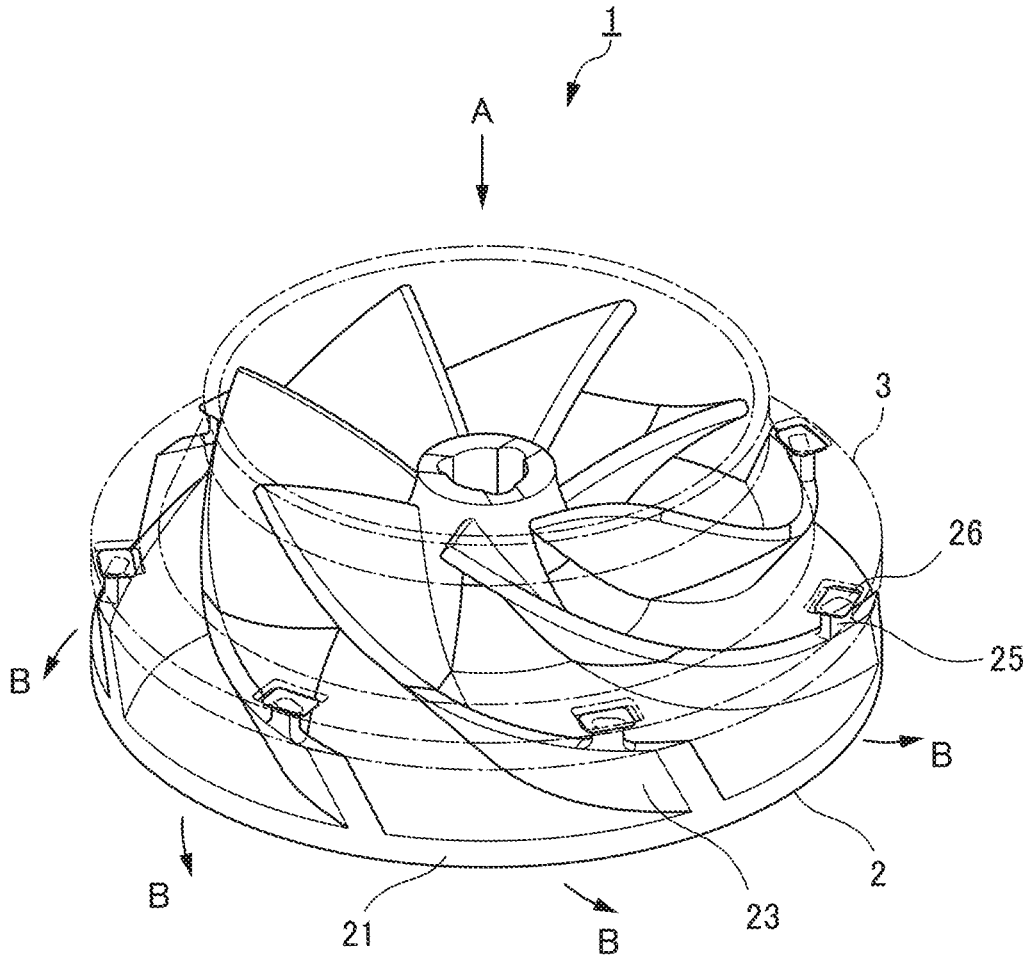
FIG. 1 is a perspective view showing an impeller according to a first embodiment of the present invention.

FIG. 1 is a perspective view showing an impeller 1 according to a first embodiment.

Figure 2A:
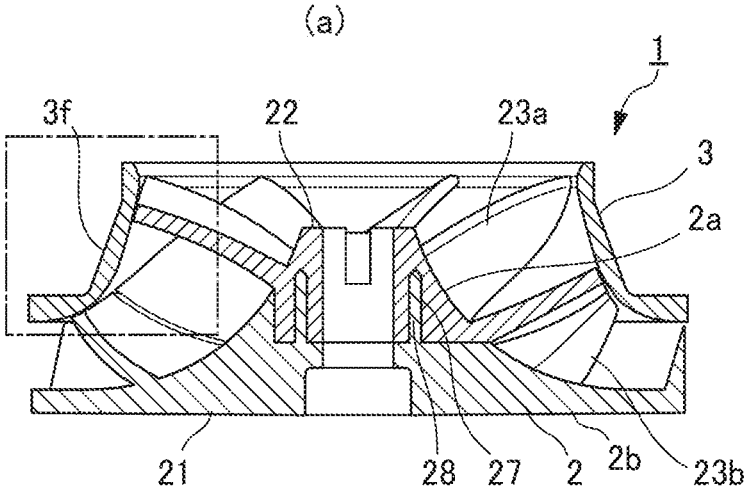
FIG. 2 is a cross-sectional view, FIG. 2(*a*) is an overall view and FIG. 2(*b*) is an enlarged view of a main portion.
Figure 2B:
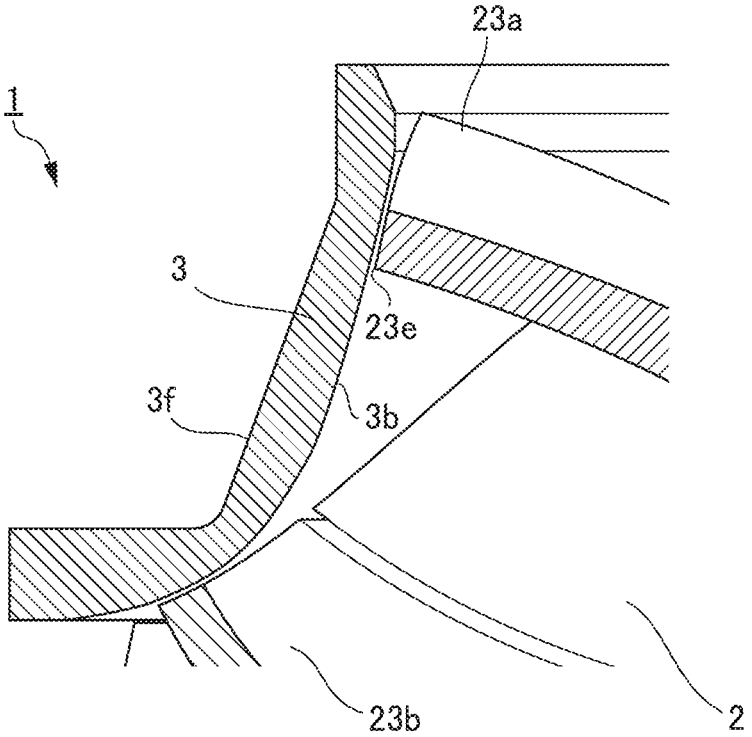

FIG. 2 is a cross-sectional view showing the impeller 1 according to the first embodiment, FIG. 2(*a*) is an overall view and FIG. 2(*b*) is an enlarged view of a main portion.

Figure 3A:
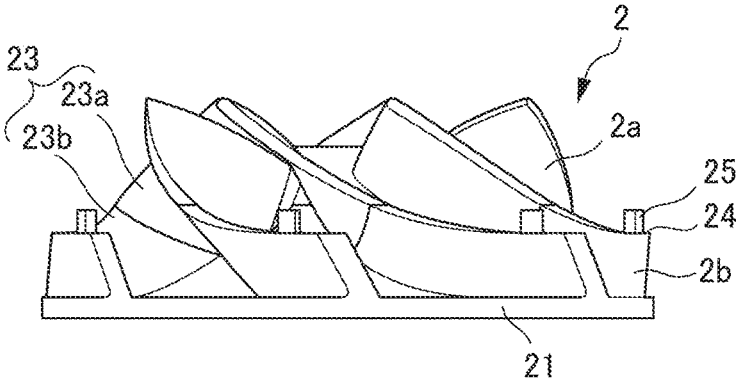
FIG. 3 is a diagram showing a blade assembly according to the first embodiment, FIG. 3(*a*) is a front view, FIG. 3(*b*) is a top view and FIG. 3(*c*) is a perspective view.
Figure 3B:
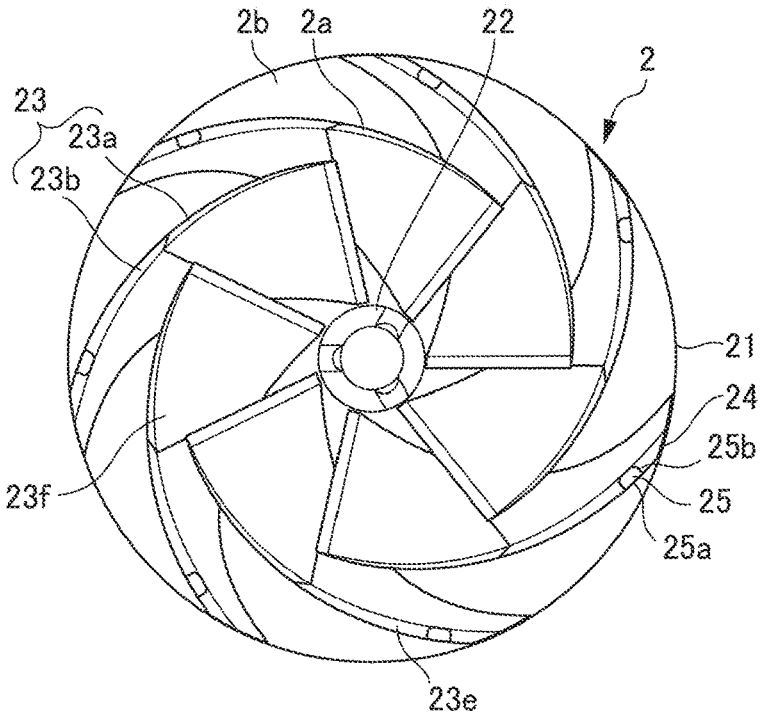
Figure 3C:
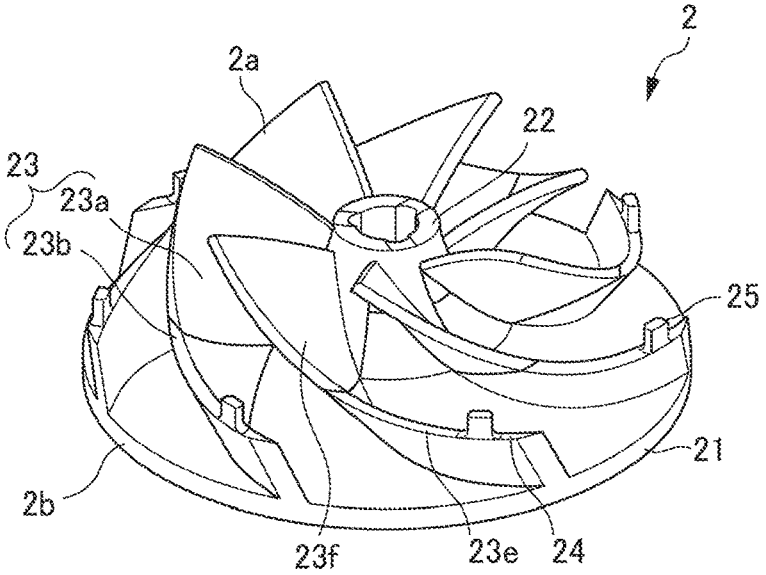

FIG. 3 is a diagram showing a blade assembly 2 according to the first embodiment, FIG. 3(*a*) is a front view, FIG. 3(*b*) is a top view and FIG. 3(*c*) is a perspective view.

Figure 4A:
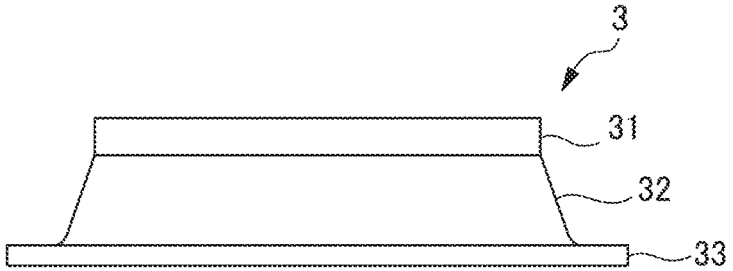
FIG. 4 is a diagram showing a shroud according to the first embodiment of the present invention, FIG. 4(*a*) is a front view, FIG. 4(*b*) is a top view and FIG. 4(*c*) is a perspective view.
Figure 4B:
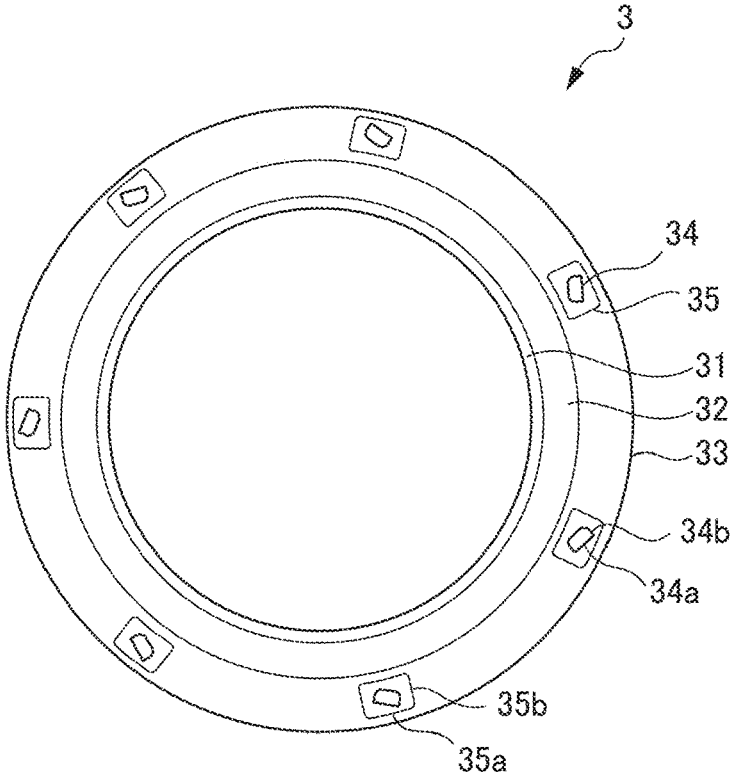
Figure 4C:
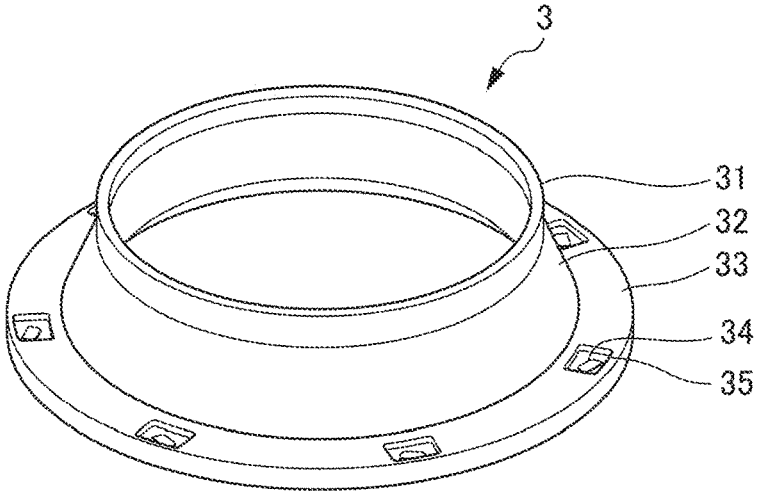

FIG. 4 is a diagram showing a shroud 3 according to the first embodiment, FIG. 4(*a*) is a front view, FIG. 4(*b*) is a top view and FIG. 4(*c*) is a perspective view.

The impeller 1 is used in, for example, a compressor or a water pump. The impeller 1 is arranged within a tubular member which passes a fluid, and is rotated by the drive of a motor to pressurize the fluid.

As shown in FIG. 1, the fluid flows into the impeller 1 from the center side of the front surface of a plurality of blades 23 as indicated by an arrow A in the figure, the fluid flowing thereinto is pressurized by the blades 23 which are rotated by the drive of the motor and the pressurized fluid is discharged from the outer circumferential portion of the impeller 1 radially as indicated by an arrow B in the figure.

As shown in FIGS. 1 and 2, the impeller 1 includes a blade assembly 2 and a shroud 3. The impeller 1 couples the shroud 3 to the blade assembly 2, and the shroud 3 covers the outer circumferential side of the blades 23.

As shown in FIG. 3, the blade assembly 2 includes a base 21 which is arranged on a back surface, a shaft portion 22 which is fixed to the base 21 and which is protruded forward from the center side of the front surface of the base 21 and the blades 23 which are extended laterally from the outer circumferential surface of the shaft portion 22.

In the blade assembly 2, when seen from the forward side in an axial direction, the blades 23 are arranged so as to be coupled in a forward and backward direction. Specifically, when seen from the forward side in the axial direction, a front blade 23*a* which is about a half of the blade 23 on the forward side appears on the forward side, and a back blade 23*b* which is about a half of the blade 23 on the backward side is hidden behind the front blade 23*a*.

The blade assembly 2 is shaped such that the blade assembly 2 alone cannot be released from an integrated mold at a time.

In each of the blades 23, the front blade 23*a* and the back blade 23*b* are coupled, and while a blade surface 23*f* is being twisted, the blade 23 is extended out to the outer circumference by drawing a spiral curve inclined with respect to the circumferential direction of the impeller 1 from the shaft portion 22.

With the blade surface 23*f* directed forward, the front blade 23*a* receives the fluid on the blade surface 23*f*. In the back blade 23*b*, the blade surface 23*f* continuous from the front blade 23*a* is provided to stand vertically with respect to the forward side toward the outside diameter. Hence, in the back blade 23*b*, a blade edge 23*e* is directed forward toward the outside diameter. The back blade 23*b* has a flat surface 24 vertical with respect to the forward side at an outer circumferential end portion with the blade edge 23*e* directed forward.

On each of the blades 23, a protrusion 25 is provided. The protrusion 25 is protruded straight to the forward side from the blade edge 23*e* on the flat surface 24 of the outer circumferential end portion of the back blade 23*b*.

The protrusion 25 is formed in the shape of a quadrangular prism whose cross section is shaped quadrangularly in which a pair of opposite sides coincide with a curve of the blade 23 extended out. The protrusion 25 is formed in a round shape such that among four corner portions formed in cross section, two corner portions on the inner side are rounded and that the two corner portions on the outer side are formed in a perpendicular shape.

In the protrusion 25, a pair of opposite sides along the curve of the blade 23 extended out are formed on a longitudinal width 25*a* which is inclined with respect to the circumferential direction of the impeller 1, and a pair of opposite sides perpendicularly intersecting the curve of the blade 23 extended out are formed on a lateral width 25*b* shorter than the longitudinal width 25*a*.

Figure 11A:
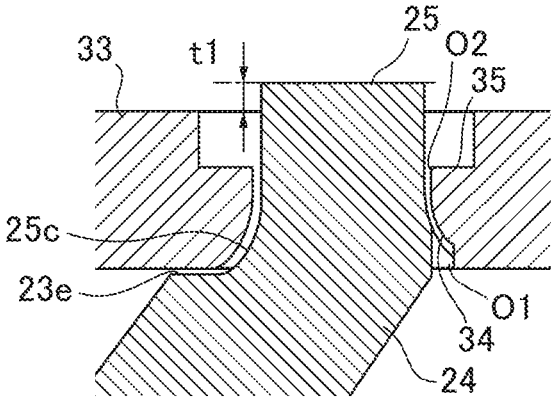
FIG. 11 is a cross-sectional view showing the protrusion and the through hole in which the impeller according to the first embodiment is joined, FIG. 11(*a*) shows the state before the joining and FIG. 11(*b*) shows the state after the joining.
Figure 11B:
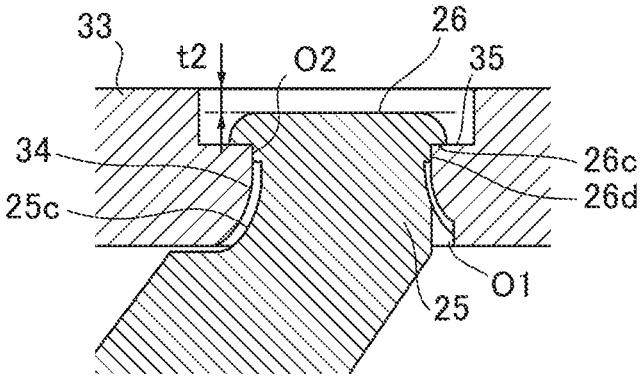

In the protrusion 25, on the flat surface 24 of the back blade 23*b*, a skirt portion 25*c* is formed on a root on the outer side with a margin from an end of the blade edge 23*e* so as to provide a thick root (see FIG. 11).

Here, when the impeller 1 is completed, the protrusion 25 forms a heat crimp portion 26 in which a tip end on the forward side is deformed.

On the back surface of the heat crimp portion 26, a locking surface 26*c* is formed which is locked to the shroud 3 (see FIG. 11).

In the heat crimp portion 26, its cross section is shaped quadrangularly such that a pair of opposite sides coincides with the circumferential direction of the impeller 1 (see FIG. 11).

The blade assembly 2 includes a first blade component 2*a* and a second blade component 2*b*, and is formed so as to be divided into the two components. As shown in FIG. 2(*a*), the entire blade assembly 2 is divided by a division surface which is substantially vertical with respect to the axial direction. Each of the blades 23 is divided into two parts by a division line which is substantially along a radial direction such that the blade 23 is divided into the front blade 23*a* and the back blade 23*b* when seen from the forward side in the axial direction.

The front blade 23*a* is extended laterally from the outer circumferential surface of the shaft portion 22. The back blade 23*b* is extended forward from the front surface of the base 21. Hence, in the base 21 and the shaft portion 22, recesses and projections and the like which couple the base 21 and the shaft portion 22 together are formed. In the base 21, a plurality of weld bars 28 are formed in a scattered manner around the shaft portion 22. In the shaft portion 22, a plurality of weld holes 27 through which the weld bars 28 are inserted are formed.

In the first blade component 2*a*, the shaft portion 22 which has a shaft hole in the center portion and a plurality of front blades 23*a* which are extended laterally from the outer circumferential surface of the shaft portion 22 are integrally formed. The front blades 23*a* are not overlaid on each other when seen from the forward side in the axial direction.

Since the front blades 23*a* are not overlaid on each other when seen from the forward side in the axial direction, the first blade component 2*a* can be molded with a mold formed with an upper mold and a lower mold.

For example, a mold is prepared which has a cavity corresponding to the first blade component 2*a* in a boundary region between the upper mold and the lower mold. The parting line of the mold is formed on the end surface of the front blade 23*a*. The cavity includes, in the shaft portion 22, a portion which has the same shape as the weld bars 28 of the second blade component 2*b*.

In the second blade component 2*b*, the base 21 which has recesses and projections that couple the shaft portion 22 to the center portion and a plurality of back blades 23*b* which are extended forward from the front surface of the base 21 are integrally formed. The back blades 23*b* are not overlaid on each other when seen from the forward side in the axial direction.

Since the back blades 23*b* and the base 21 are overlaid on each other when seen from the forward side in the axial direction, the second blade component 2*b* can be molded with a mold formed with an upper mold, a lower mold and a plurality of slides (nesting type) which are divided in the circumferential direction sandwiched therebetween.

For example, in a boundary region between the upper mold, the lower mold and the slides, a mold having a cavity corresponding to the second blade component 2*b* is prepared. The parting line of the mold is formed on part of the base 21 and the end surface of the back blade 23*b*. The cavity includes, in the base 21, a portion which has the same shape as the weld holes 27 through which the weld bars 28 of the second blade component 2*b* are inserted.

With this mold, a desired plastic material is injection-molded. After the molding, the slides of the mold are released radially from between the upper mold and the lower mold, thereafter the upper mold is released upward and the lower mold is released downward, with the result that the second blade component 2*b* is released from the mold without fail.

The first blade component 2*a* and the second blade component 2*b* are coupled by respectively inserting the weld bars 28 through the weld holes 27 in phase and welding the tip ends of the weld bars 28 by ultrasound. Consequently, a plurality of front blades 23*a* and a plurality of back blades 23*b* are adjacent to each other through the division line, and are smoothly continuous. In this way, it is possible to obtain the blade assembly 2 in which the first blade component 2*a* and the second blade component 2*b* are integrally formed.

Since the front blades 23*a* and the back blades 23*b* are smoothly continuous, they may be configured such that the protrusion portions thereof are overlaid on each other in the region of the division line. In this way, a minute clearance is prevented from being formed in the region of the division region, the flow of the fluid is prevented from being affected and the efficiency of the impeller 1 is not impeded.

As shown in FIG. 4, the shroud 3 includes: a cylindrical portion 31 of a shaft center along the direction of the passing of the fluid on the front surface; a curved portion 32 which is formed in the shape of a curved cylinder and in which its diameter is increased backward while the curved portion 32 is curved from the cylindrical portion 31 along the blade edge 23*e* so as to correspond to the shape of a plurality of blades 23; and a flat portion 33 which is formed in the shape of a circular ring and in which in the outer circumferential portion of the curved portion 32, a front surface and a back surface vertical with respect to the forward side are formed.

The cylindrical portion 31, the curved portion 32 and the flat portion 33 of the shroud 3 are substantially equal in thickness and are continuous. The shroud 3 is arranged opposite the base 21 of the blade assembly 2 through the blades 23.

As shown in FIGS. 2(*a*) and 2(*b*), a surface 3*f* appearing on the front surface of the shroud 3 has a minute clearance with respect to the inner circumferential surface of the tubular member. As shown in FIG. 2(*b*), a back surface 3*b* opposite the blade assembly 2 of the shroud 3 has a minute clearance with respect to the blade edge 23*e* of the blades 23 which is the closest thereto.

As shown in FIG. 4, in the flat portion 33 of the shroud 3, a plurality of through holes 34 are provided. The protrusions 25 which are formed on the blades 23 are respectively inserted through the through holes 34.

The through hole 34 has a straight axis line along the forward side such that the protrusion 25 can be inserted through the through hole 34, and has a larger diameter than the protrusion 25 through the minute clearance with respect to the protrusion 25.

The through hole 34 is formed in a space whose cross section is shaped quadrangularly and which coincides with the protrusion 25 formed in the shape of a quadrangular prism where a pair of opposite sides coincide with the curve of the blade 23 of the blade assembly 2 extended out in a state where the protrusion 25 is inserted.

The through hole 34 is formed in a round shape such that among four corner portions formed in cross section, two corner portions on the inner side are rounded and that the two corner portions on the outer side are formed in a perpendicular shape. In the through hole 34, as in the protrusion 25, a pair of opposite sides along the curve of the blade 23 extended out are formed on a longitudinal width 34*a* which is inclined with respect to the circumferential direction of the impeller 1, and a pair of opposite sides perpendicularly intersecting the curve of the blade 23 extended out are formed on a lateral width 34*b* shorter than the longitudinal width 34*a*.

The through hole 34 is formed such that the skirt portion 25*c* of the protrusion 25 can be held and that an opening diameter O1 on the back surface side is larger than an opening diameter O2 on the front surface side so as to correspond to the shape of the protrusion 25 (see FIG. 11).

When the impeller 1 is completed, the through hole 34 locks the heat crimp portion 26 formed on the front surface side and joins the blade assembly 2 and the shroud 3.

In the flat portion 33 of the shroud 3, a concave portion 35 which surrounds the through hole 34 is provided.

The concave portion 35 is formed in the surface on the front surface side of the flat portion 33 of the shroud 3 where the tip end of the protrusion 25 inserted through the through hole 34 is protruded.

In the concave portion 35, its cross section is shaped quadrangularly such that a pair of opposite sides coincides with the circumferential direction of the flat portion 33 of the shroud 3, so a width of the through hole 34 is inclined relative to a width of the concave portion 35 on a plane of the flat portion 33 of the shroud 3.

In the concave portion 35, all four corner portions formed in cross section are formed in a perpendicular shape. In the concave portion 35, a pair of opposite sides along the circumferential direction of the impeller 1 is formed on a longitudinal width 35*a*, and a pair of opposite sides along the radial direction of the impeller 1 is formed on a lateral width 35*b* shorter than the longitudinal width 35*a*.

The concave portion 35 has a depth which is uniformly recessed by one stage with respect to the surface on the front surface side of the flat portion 33 of the shroud 3. The depth of the concave portion 35 holds the heat crimp portion 26 of the protrusion 25 formed on the front surface side when the impeller 1 is completed, and prevents the heat crimp portion 26 from being protruded as compared with the flat portion 33 of the shroud 3 (see FIG. 11).

The joining of the blade assembly 2 and the shroud 3 in the impeller 1 will then be described.

In a method of joining the blade assembly 2 and the shroud 3, a plurality of protrusions 25 are inserted through a plurality of through holes 34, then the tip end of the protrusion 25 is deformed to have a larger diameter than the opening diameter O2 on the front surface side of the through hole 34 such that the longitudinal width 25*a* of the tip end of the protrusion 25 coincides with the circumferential direction of the impeller 1 and thus the flat surface 24 of each of a plurality of blades 23 and the flat portion 33 of the shroud 3 are joined.

Firstly, a plurality of protrusions 25 are respectively inserted into a plurality of through holes 34.

Figure 5:
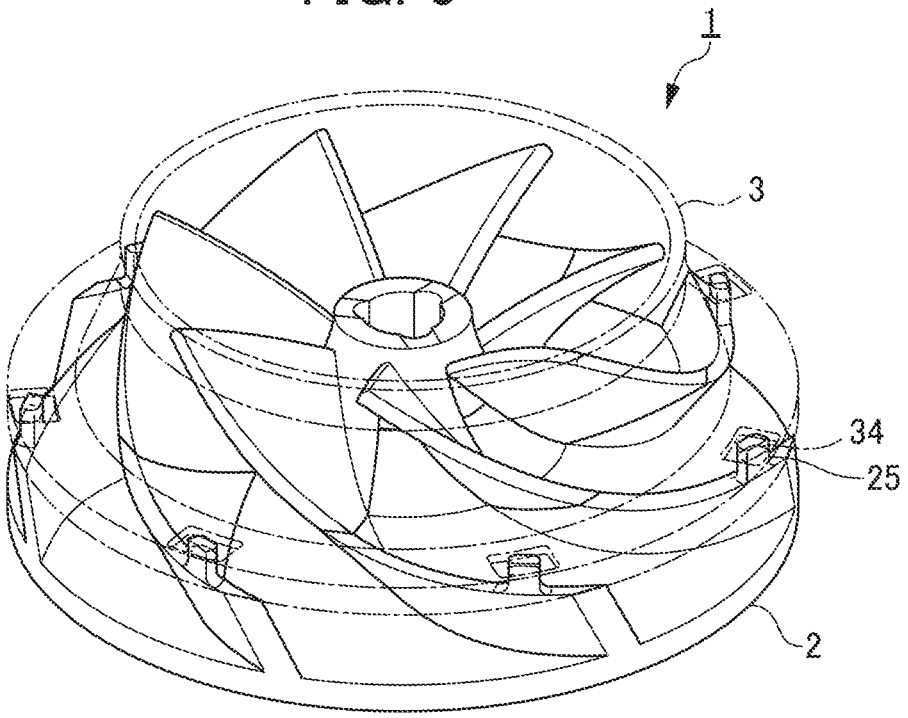
FIG. 5 is a perspective view showing a state before the impeller according to the first embodiment is joined.

FIG. 5 is a perspective view showing a state before the impeller 1 according to the first embodiment is joined.

As shown in FIG. 5, the blade assembly 2 and the shroud 3 are brought into the state before the joining by respectively inserting the protrusions 25 through the through holes 34.

When the protrusion 25 is inserted through the through hole 34, since the two corner portions and the two corner portions on the inner side of the protrusion 25 and the through hole 34 are formed in a round shape, the protrusion 25 is smoothly inserted while the blade 23 is bent toward the side of the inside diameter without the two corner portions on the inner side of the protrusion 25 caught in the through hole 34.

Secondly, the tip end of the protrusion 25 inserted through the through hole 34 is dissolved, and thus heat crimping is performed.

Figure 6:
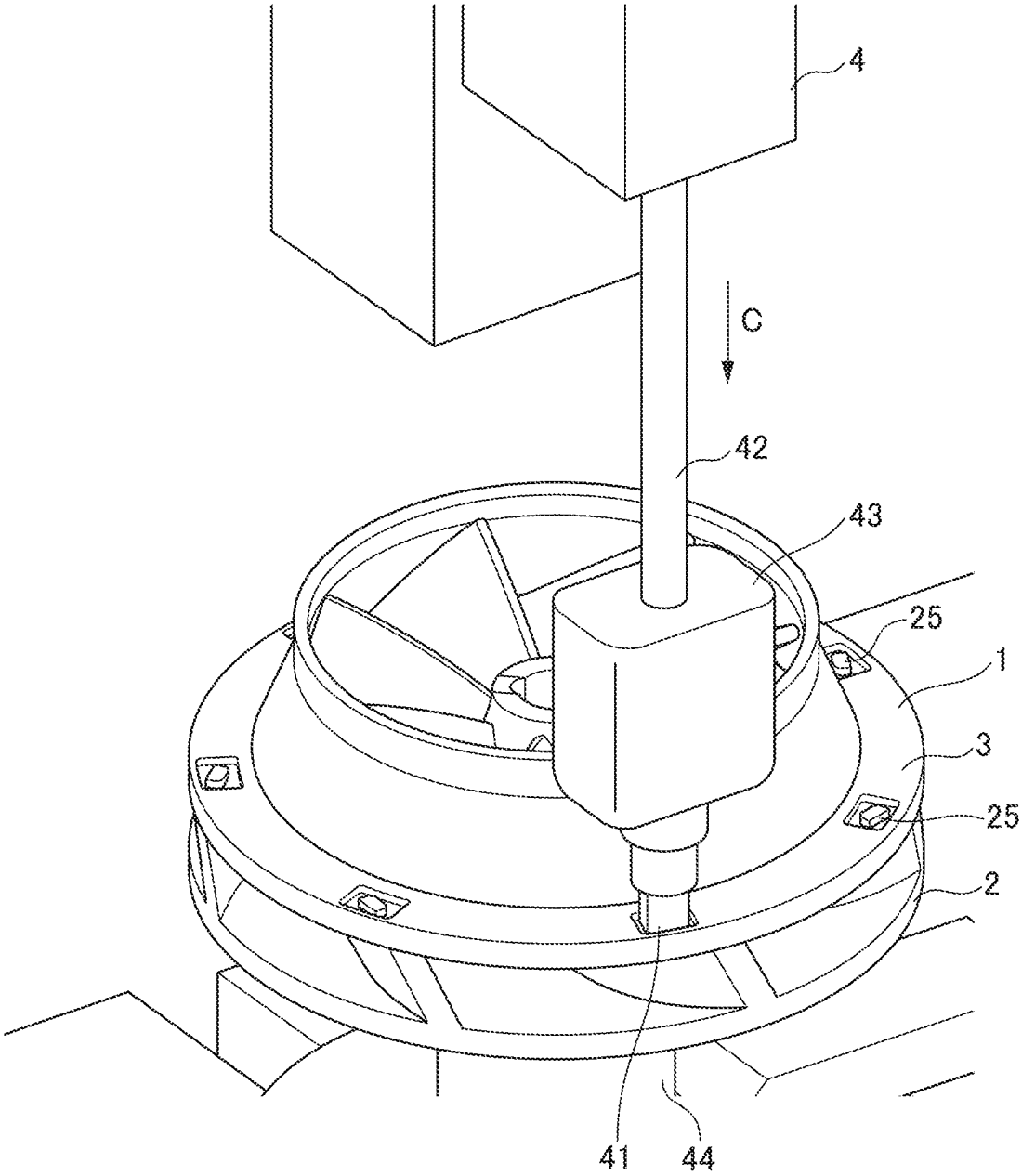
FIG. 6 is a perspective view showing an operation of joining the impeller according to the first embodiment.

FIG. 6 is a perspective view showing an operation of joining the impeller 1 according to the first embodiment.

As shown in FIG. 6, the heat crimp portion 26 is formed by heat crimping using a heat crimp device 4 to dissolve the tip end of the protrusion 25, and thus the blade assembly 2 and the shroud 3 in the impeller 1 are joined. In the heat crimp portion 26 formed by the dissolved tip end of the protrusion 25, the locking surface 26*c* which is locked to the through hole 34 is formed.

When the flat portion 33 of the shroud 3 is pressed by the heat crimp device 4 from the forward side, the back surface of the flat portion 33 and the flat surface 24 of the back blade 23*b* are brought into contact with each other without any gap, and in this state, the heat crimp portion 26 is formed.

Here, the heat crimp device 4 includes: a heating mold 41 which is shaped so as to be held within the concave portion 35 of the shroud 3 and which forms the heat crimp portion 26 from the tip end of the protrusion 25 to be heated and dissolved; a slide shaft 42 which supports the heating mold 41 and which slides, as indicated by an arrow C in the figure, straight from upward that is the forward side of the impeller 1 to downward; and an insulating portion 43 which is fixed to the slide shaft 42 and which prevents heat transfer from the heating mold 41.

The heat crimp device 4 also includes a rotating table 44 which locates the protrusion 25 in a heat crimp position where the heating mold 41 slides, as indicated by the arrow C in the figure, straight downward (from the forward side to the backward side of the impeller 1) to perform heat crimping and which thereby retains the impeller 1 in the state before the joining. When the heat crimping of one place is completed, the rotating table 44 rotates the installed impeller 1 in the state before the joining to locate, in the heat crimp position, a protrusion 25 adjacent to the protrusion 25 in which the heat crimping is completed in order to perform the subsequent heat crimping.

Here, the joining of the blade assembly 2 and the shroud 3 in the impeller 1 will be described.

Figure 7A:
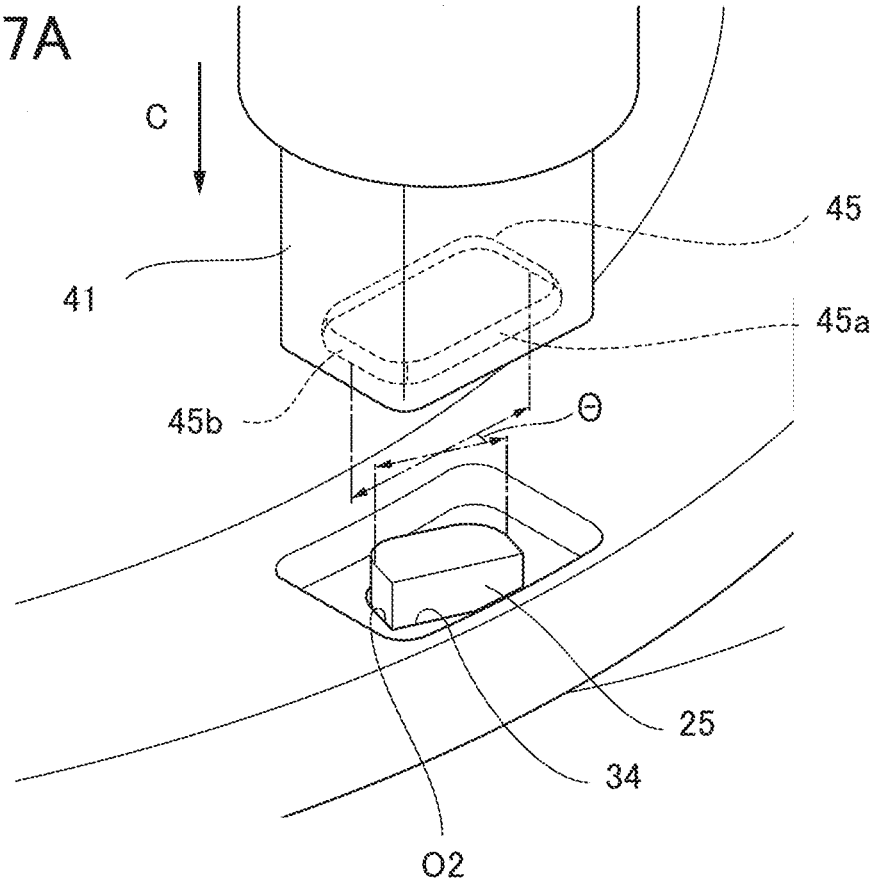
FIG. 7 is a perspective view showing a joint portion of the impeller according to the first embodiment, FIG. 7(*a*) shows a state immediately before the joint portion and FIG. 7(*b*) shows a state when the joint portion is joined.
Figure 7B:
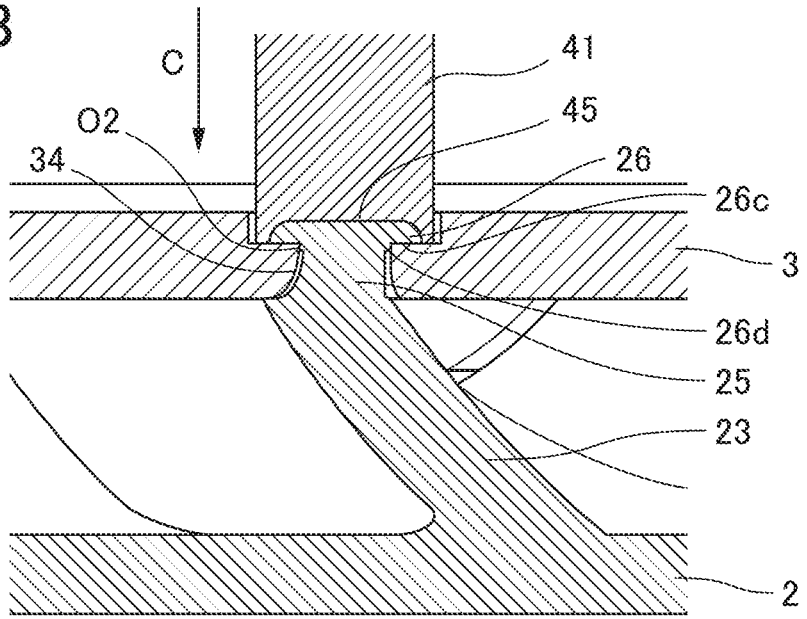

FIG. 7 is a perspective view showing a joint portion of the impeller according to the first embodiment, FIG. 7(*a*) shows a state immediately before the joint portion and FIG. 7(*b*) shows a state when the joint portion is joined.

As shown in FIG. 7(*a*), in the heating mold 41 of the heat crimp device 4, a cavity concave portion 45 is formed which is opened downward opposite the impeller 1 installed on the rotating table 44 and which coincides with the heat crimp portion 26. The cavity concave portion 45 has a larger diameter than the opening diameter O2 on the front surface side of the through hole 34, and is, as with the concave portion 35 of the shroud 3, formed in a space whose cross section is shaped quadrangularly and in which a pair of opposite sides coincide with the circumferential direction of the impeller 1.

In the cavity concave portion 45, all four corner portions formed in cross section are formed in a perpendicular shape.

In the cavity concave portion 45, a pair of opposite sides along the circumferential direction of the impeller 1 is formed on a longitudinal width 45*a*, and a pair of opposite sides along the radial direction of the impeller 1 is formed on a lateral width 45*b* shorter than the longitudinal width 45*a*. In other words, the longitudinal width 25*a* (which is inclined with respect to the circumferential direction of the impeller 1) of the tip end of the protrusion 25 included in the impeller 1 in the state before the joining installed on the rotating table 44 and the longitudinal width 45*a* (which coincides with the circumferential direction of the impeller 1) of the cavity concave portion 45 included in the heating mold 41 of the heat crimp device 4 have different angles Θ.

As shown in FIG. 7(*b*), in the heat crimping, the heating mold 41 heated to a high temperature is not rotated, and the slide shaft 42 is made to slide, as indicated by the arrow C in the figure, straight downward. In this way, the cavity concave portion 45 is pressed to the tip end of the protrusion 25, the tip end of the protrusion 25 is dissolved and thus the heat crimp portion 26 is formed within the concave portion 35 so as to correspond in shape to the cavity concave portion 45 of the heating mold 41. Since the heating mold 41 is held within the concave portion 35 and simultaneously presses the flat portion 33, the flat surface 24 and the flat portion 33 are brought into contact with each other without any gap, and in this state, the heat crimp portion 26 formed prevents the flat portion 33 from floating from the flat surface 24.

While the heating mold 41 dissolves the tip end of the protrusion 25, the heating mold 41 is pressed, as indicated by the arrow C in the figure, straight into the concave portion 35 of the flat portion 33 of the shroud 3. The dissolved material obtained by dissolving of the tip end of the protrusion 25 is dispersed substantially uniformly around the protrusion 25 within the cavity concave portion 45 of the heating mold 41. Then, even when a minute clearance is produced between the protrusion 25 and the through hole 34, the dissolved material within the cavity concave portion 45 is pressed into the clearance so as to be formed in the heat crimp portion 26 while filling an outer layer portion of the clearance (see FIG. 11). Since the cavity concave portion 45 of the heating mold 41 holds the entire circumferential direction of the tip end of the protrusion 25, even when the minute clearance between the protrusion 25 and the through hole 34 is produced in an indefinite part on the circumference, the dissolved material within the cavity concave portion 45 is pressed into the clearance no matter which part on the circumference the dissolved material is in, with the result that the dissolved material can fill the outer layer of the clearance. Since the dissolved material within the cavity concave portion 45 is dispersed substantially uniformly around the protrusion 25, the dissolved material is moved around to the vicinity of the contact portion between the protrusion 25 and the through holes 34, no gap is formed between the dissolved material embedded in the minute clearance and the contact portion and the dissolved material 26*d* fills the area between the protrusion 25 and the through holes 34. Hence, the blade assembly 2 and the shroud 3 are prevented from being joined loosely, and are joined firmly.

Furthermore, the joint of the blade assembly 2 and the shroud 3 in the impeller 1 will be specifically described.

Figure 8A:
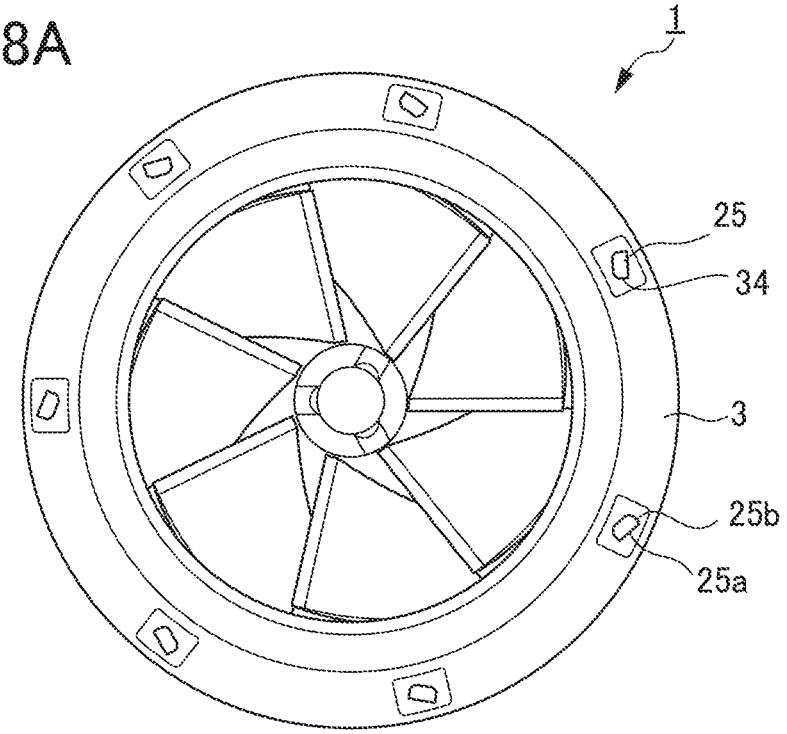
FIG. 8 is a top view showing states before and after the impeller according to the first embodiment is joined, FIG. 8(*a*) shows the state before the joining and FIG. 8(*b*) shows the state after the joining.
Figure 8B:
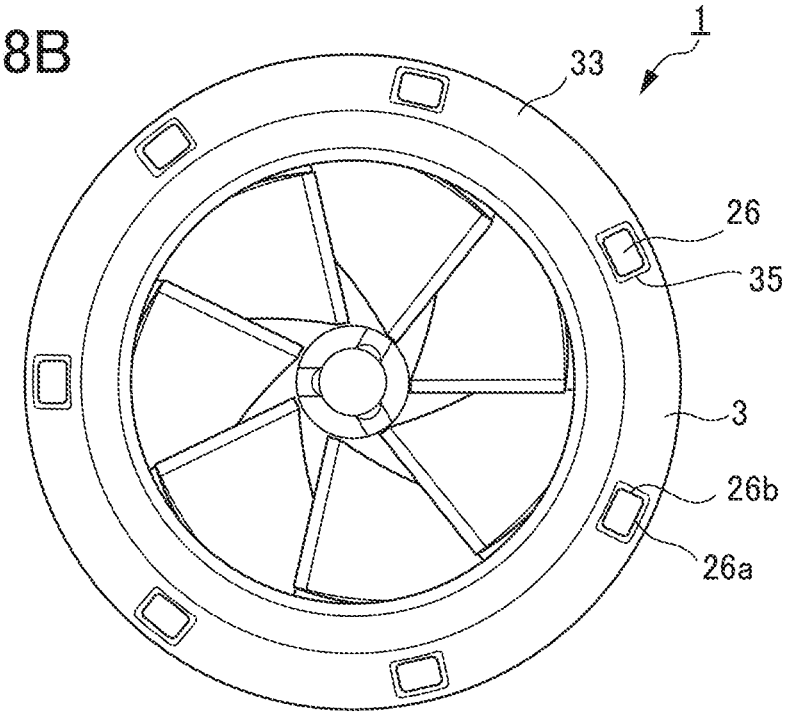

FIG. 8 is a top view showing states before and after the impeller 1 according to the first embodiment is joined, FIG. 8(*a*) shows the state before the joining and FIG. 8(*b*) shows the state after the joining.

Figure 9A:
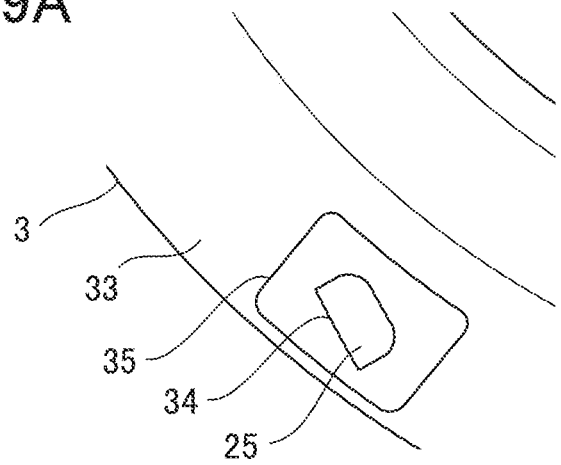
FIG. 9 is a top view showing a protrusion and a through hole in which the impeller according to the first embodiment is joined, FIG. 9(*a*) shows the state before the joining and FIG. 9(*b*) shows the state after the joining.
Figure 9B:
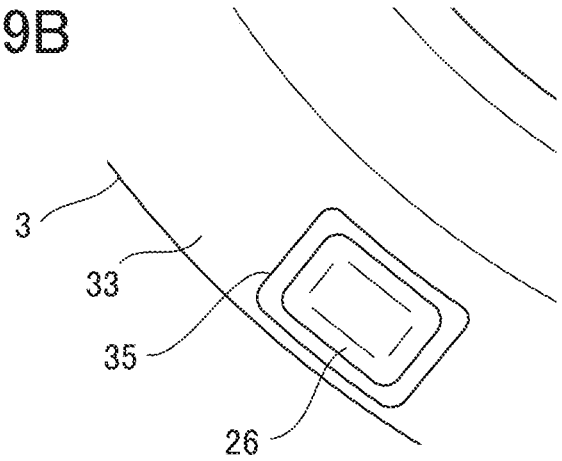

FIG. 9 is a top view showing the protrusion 25 and the through hole 34 in which the impeller 1 according to the first embodiment is joined, FIG. 9(*a*) shows the state before the joining and FIG. 9(*b*) shows the state after the joining.

Figure 10A:
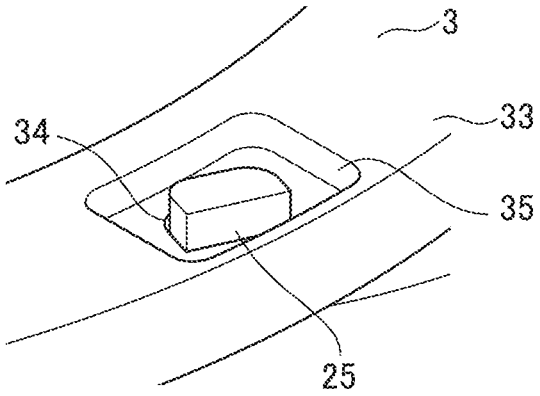
FIG. 10 is a perspective view showing the protrusion and the through hole in which the impeller according to the first embodiment is joined, FIG. 10(*a*) shows the state before the joining and FIG. 10(*b*) shows the state after the joining.
Figure 10B:
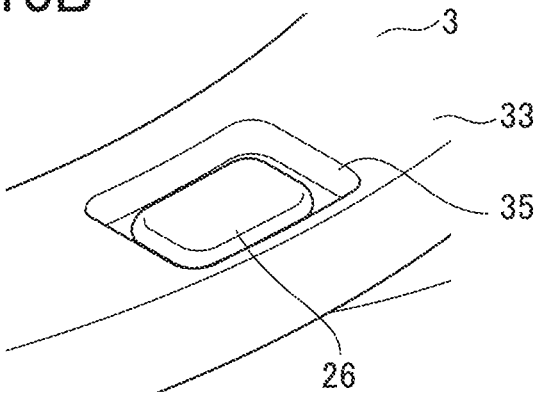

FIG. 10 is a perspective view showing the protrusion 25 and the through hole 34 in which the impeller 1 according to the first embodiment is joined, FIG. 10(*a*) shows the state before the joining and FIG. 10(*b*) shows the state after the joining.

FIG. 11 is a cross-sectional view showing the protrusion 25 and the through hole 34 in which the impeller 1 according to the first embodiment is joined, FIG. 11(*a*) shows the state before the joining and FIG. 11(*b*) shows the state after the joining.

As shown in FIGS. 8(*a*), 9(*a*), 10(*a*) and 11(*a*), in the tip end of the protrusion 25 before the joining, the longitudinal width 25*a* coincides with the curve of the blade 23 extended out, and the lateral width 25*b* perpendicularly intersects the curve of the blade 23.

As shown in FIG. 11(*a*), the tip end of the protrusion 25 before the joining is protruded forward from the front surface of the flat portion 33 of the shroud 3 by t1.

The protrusion 25 has the skirt portion 25*c* which is formed on the root on the outer side with a margin from the end of the blade edge 23*e* in the flat surface 24 of the back blade 23*b*. The through hole 34 is formed such that the skirt portion 25*c* of the protrusion 25 can be held and that the opening diameter O1 on the back surface side is larger than the opening diameter O2 on the front surface side so as to correspond to the shape of the protrusion 25.

As shown in FIGS. 8(*b*), 9(*b*), 10(*b*) and 11(*b*), in the heat crimp portion 26 of the protrusion 25 after the joining formed by dissolving of the tip end of the protrusion 25, a longitudinal width 26*a* coincides with the circumferential direction of the impeller 1, and a lateral width 26*b* coincides with the radial direction of the impeller 1.

In other words, the longitudinal width 25*a* (which is inclined with respect to the circumferential direction of the impeller 1) of the tip end of the protrusion 25 included in the impeller 1 in the state before the joining and the longitudinal width 26*a* (which coincides with the circumferential direction of the impeller 1) of the heat crimp portion 26 have different angles Θ (angles shown in FIG. 7(*a*)). The heat crimp portion 26 has a similar shape in which the concave portion 35 formed in the flat portion 33 of the shroud 3 is slightly decreased in size toward the center side.

The heat crimp portion 26 has a larger diameter than the opening diameter O2 on the front surface side of the through hole 34. On the back surface side of the heat crimp portion 26, the locking surface 26*c* is formed which makes contact with the surface of the concave portion 35 of the flat portion 33 of the shroud 3.

The heat crimp portion 26 has a large diameter so as to spread over the entire circumference with respect to the diameter of the protrusion 25 inserted through the through holes 34 and a large contact area in which the locking surface 26*c* formed on the back surface is in contact with the surface of the concave portion 35, with the result that an effect of preventing the removal is significant.

The heat crimp portion 26 makes the longitudinal width 26*a* coincide with the circumferential direction of the impeller 1 and has a large diameter so as to spread over the entire circumference with respect to the diameter of the protrusion 25. Hence, even when the heat crimp portion 26 has a small width in the radial direction of the flat portion 33 of the shroud 3, the heat crimp portion 26 can be formed, without fail, within the concave portion 35 in which the longitudinal width 35*a* coincides with the circumferential direction of the impeller 1 and in which the lateral width 35*b* coincides with the radial direction of the impeller 1.

As shown in FIG. 11(*b*), the heat crimp portion 26 of the protrusion 25 after the joining formed by dissolving of the tip end of the protrusion 25 is held within the concave portion 35 on the front surface of the flat portion 33 of the shroud 3 and is retracted backward with respect to the concave portion 35 (is not protruded forward from the front surface of the flat portion 33 of the shroud 3 by only t2).

The heat crimp portion 26 pushes the dissolved material 26*d* into the minute clearance produced between the protrusion 25 and the through hole 34 to fill the outer layer portion of the clearance.

With the impeller 1 according to the first embodiment, the following effects are achieved.

(1) The flat surface 24 of the blade 23 and the flat portion 33 of the shroud 3 are joined.

As described above, the flat surface 24 of the blade 23 and the flat portion 33 of the shroud 3 are only joined, and thus the flat surface 24 and the flat portion 33 have simple flat shapes and form a narrow joint range. Hence, high accuracy is not required for making the flat surface 24 of the blade 23 and the flat portion 33 of the shroud 3 coincide with each other in the narrow joint range, and thus the productivity is satisfactory. Moreover, the flat surface 24 of the blade 23 and the flat portion 33 of the shroud 3 can be easily made to coincide with each other, no clearance is produced between the flat surface 24 of the blade 23 and the flat portion 33 of the shroud 3 and the joint is formed firmly. Thus, it is possible to stably join the blade 23 and the shroud 3.

(2) The protrusion 25 is inserted through the through hole 34, and thereafter the tip end of the protrusion 25 is deformed to have a larger diameter than the opening diameter O2 of the through hole 34, with the result that the flat surface 24 of the blade 23 and the flat portion 33 of the shroud 3 are joined.

Since as described above, the protrusion 25 is inserted through the through hole 34, and thereafter the tip end of the protrusion 25 is deformed to have a larger diameter than the opening diameter O2 of the through hole 34, the deformed heat crimp portion 26 of the protrusion 25 is locked to the through hole 34, and thus it is possible to firmly join, only at the place of the protrusion 25, the flat surface 24 of the blade 23 and the flat portion 33 of the shroud 3.

(3) In the flat portion 33 of the shroud 3, the concave portion 35 surrounding the through hole 34 is provided.

As described above, in the flat portion 33 of the shroud 3, the concave portion 35 surrounding the through hole 34 is provided, and thus the heat crimp portion 26 of the protrusion 25 deformed to have a larger diameter than the opening diameter O2 of the through hole 34 can be surrounded by the concave portion 35. Hence, the deformed heat crimp portion 26 of the protrusion 25 can be held within the concave portion 35, and the deformed heat crimp portion 26 of the protrusion 25 does not inhibit the flow of the fluid passing through the impeller 1, with the result that it is possible to enhance the performance of the impeller 1.

(4) The protrusion 25 is inserted through the through hole 34, and thereafter the heat crimp portion 26 of the protrusion 25 is deformed such that the longitudinal width 26*a* of the heat crimp portion 26 of the protrusion 25 coincides with the circumferential direction.

Since as described above, the protrusion 25 is inserted through the through hole 34, and thereafter the heat crimp portion 26 of the protrusion 25 is deformed such that the longitudinal width 26*a* of the heat crimp portion 26 of the protrusion 25 coincides with the circumferential direction, even when the flat portion 33 of the shroud 3 is narrow, it is possible to acquire such a large contact area that the deformed heat crimp portion 26 of the protrusion 25 is locked to the through hole 34. Hence, the deformed heat crimp portion 26 of the protrusion 25 is reliably locked to the through hole 34, and thus it is possible to firmly join, only at the place of the protrusion 25, the flat surface 24 of the blade 23 and the flat portion 33 of the shroud 3.

The present invention is not limited to the embodiment described above, and as long as it is possible to achieve the object of the present invention, variations and modifications are included in the present invention.

In the embodiment described above, as the joining method, heat crimping is used. However, there is no limitation on this configuration. The joining method may be to apply an adhesive to the concave portion around the protrusion inserted through the through hole.

In the embodiment described above, the blade assembly is configured by integrally forming the two components. However, there is no limitation on this configuration. The blade assembly may be formed with one or two or more components.

Second Embodiment

The configuration of an impeller 61 according to a second embodiment of the present invention will be described.

Figure 12:
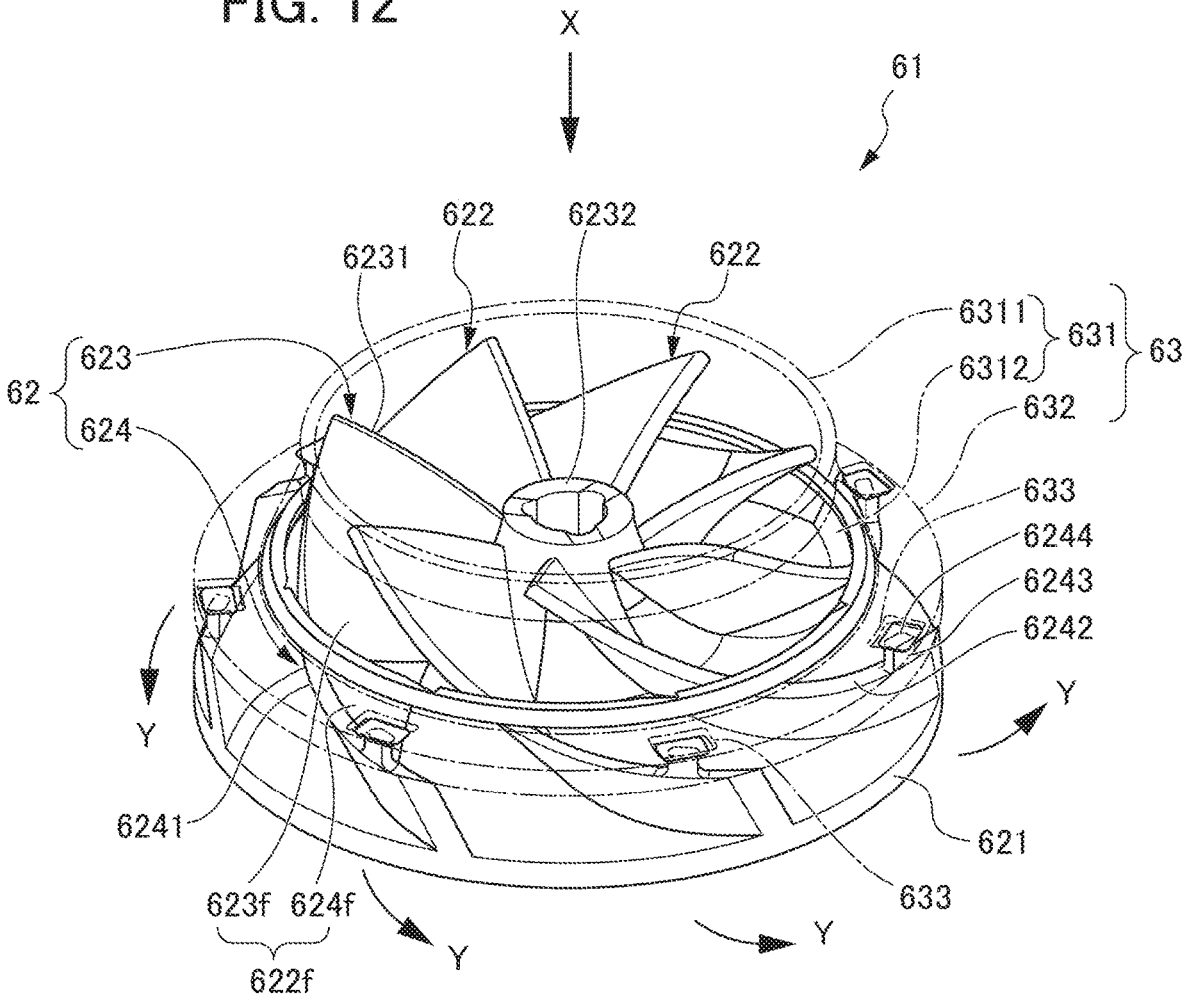
FIG. 12 is a perspective view showing an impeller according to a second embodiment of the present invention.
Figure 13:
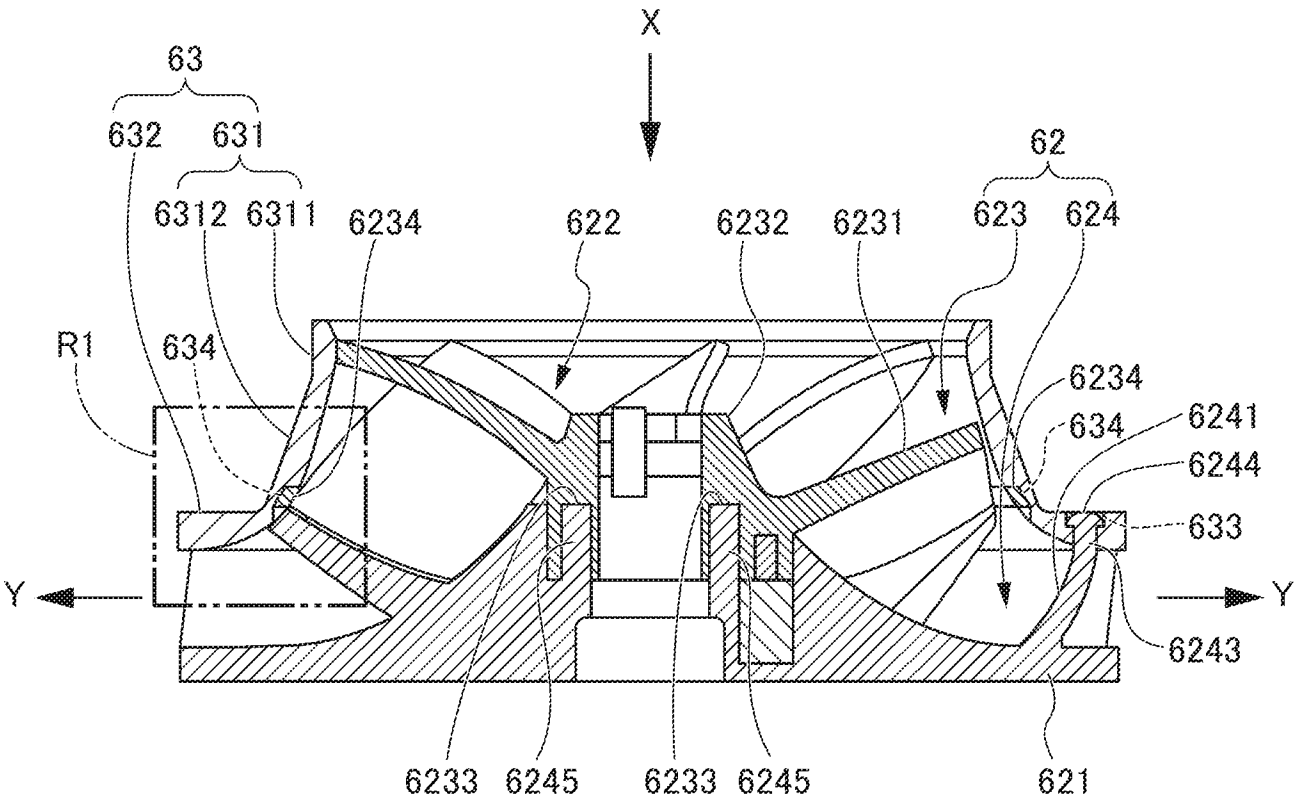
FIG. 13 is a cross-sectional view of the impeller according to the second embodiment.
Figure 14:
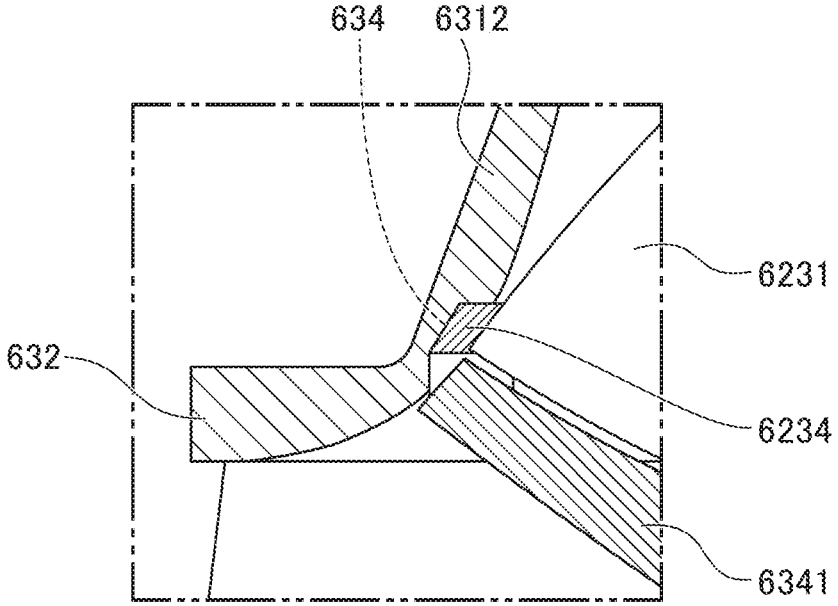
FIG. 14 is a cross-sectional view of the impeller according to the second embodiment and is an enlarged view of a main portion in FIG. 13.

FIG. 12 is a perspective view showing the impeller 61 according to the second embodiment of the present invention. FIG. 13 is a cross-sectional view of the impeller 61. FIG. 14 is a cross-sectional view of the impeller 61 and is an enlarged view of a main portion R1 in FIG. 13.

The impeller 61 is used in, for example, a compressor or a water pump. The impeller 61 is arranged within a tubular member which passes the fluid, and is rotated by the drive of a motor to pressurize the fluid.

As shown in FIG. 12, the fluid flows into the impeller 61 from the center side of the front surface of a plurality of blades 622 which will be described later from a direction indicated by an arrow X in the figure. The fluid flowing thereinto is pressurized by the blades 622 which are rotated by the drive of the motor and the pressurized fluid is discharged from the outer circumferential portion of the impeller 61 radially in a direction indicated by an arrow Y in the figure. In the present specification, it is assumed that the side (the upper side of FIG. 13) where the fluid of the impeller 61 flows in is the front surface and that the opposite side (the lower side of FIG. 13) is the back surface.

As shown in FIG. 12, the impeller 61 includes a blade member 62 and a shroud 63.

The blade member 62 includes a base 621 and a plurality of blades 622 arranged on the base 621. The base 621 is formed such that the base 621 is arranged on the back surface side and that the center portion on the front surface side bulges. The blade 622 is fixed to the base 621, and is extended out to the outer circumferential side.

The blade member 62 is shaped such that the blade member 62 alone cannot be released from an integrated mold at a time.

The shroud 63 is arranged on the front surface side opposite the base 621 through the blades 622. The shroud 63 is arranged on the outer circumferential side of the blades 622 to cover the blades 622. The shroud 63 includes a main body portion 631 which is formed in the shape of a cylinder and a flange portion 632 which is formed on the circumferential edge of an end portion on the side of the base 621 and in which the surface on the side of the base 621 is formed in the shape of a flat surface. Furthermore, the main body portion 631 includes a cylindrical portion 6311 which is arranged on the front surface side and which is formed in the shape of a cylinder and an inclination portion 6312 which is extended from the back surface side of the cylindrical portion 6311 to the base end of the flange portion 632 and is inclined. The shroud 63 includes a plurality of engaged portions 633 which are formed in the flange portion 632. The engaged portion 633 is formed in the shape of a hole such that an engagement portion 6243 which will be described later included in a second blade member 624 engages therewith. As shown in FIG. 14, the shroud 63 includes a concave portion 634 formed in the inner side thereof.

Figure 15A:
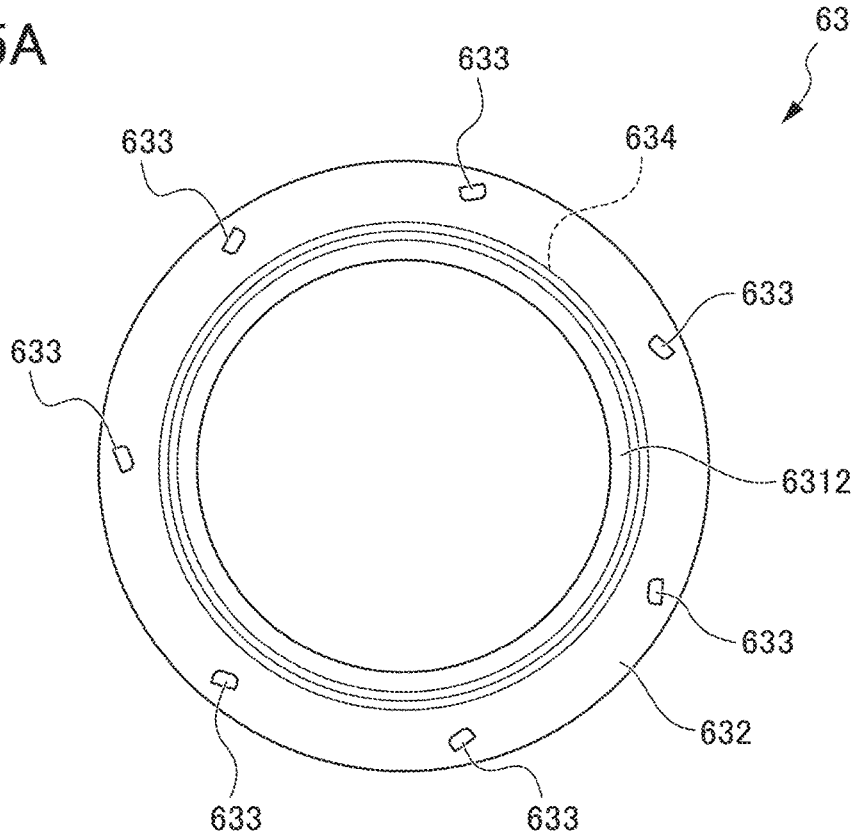
FIG. 15 is a diagram showing a shroud of the impeller according to the second embodiment, FIG. 15(*a*) is a bottom view and FIG. 15(*b*) is a perspective view when seen from the side of a bottom surface (back surface)
Figure 15B:
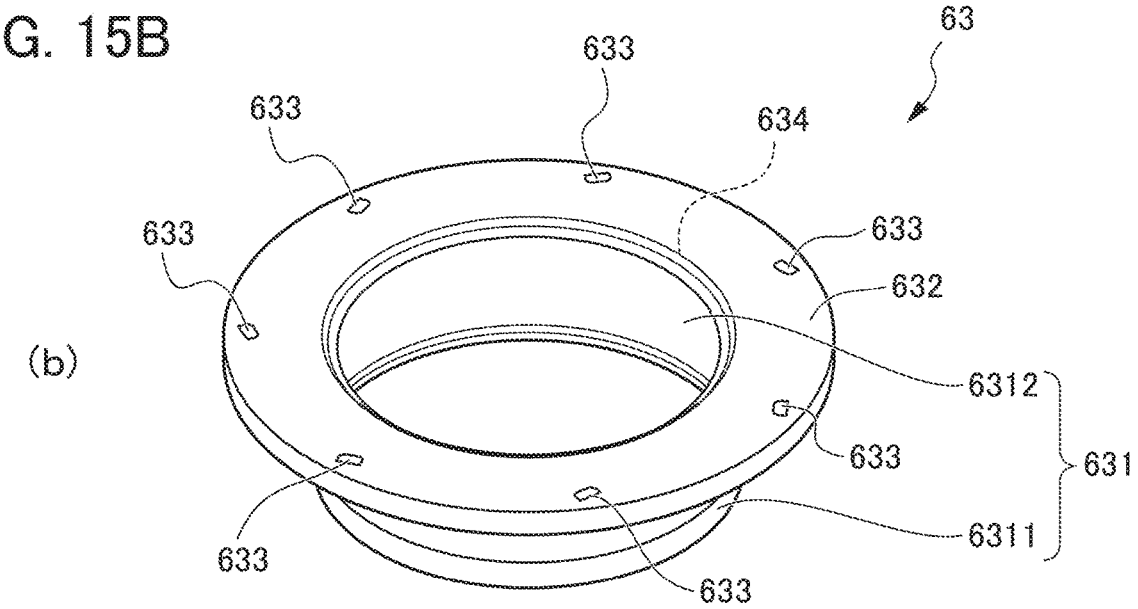

FIG. 15 is a diagram showing the shroud 63, FIG. 15(*a*) is a bottom view and FIG. 15(*b*) is a perspective view when seen from the side of a bottom surface (back surface).

As shown in FIG. 15, the concave portion 634 is formed over the entire circumference of the shroud 63 so as to coincide with a boundary between the main body portion 631 and the flange portion 632. As shown in FIG. 15, a plurality of engaged portions 633 are formed at regular intervals in the flange portion 632. The shroud 63 can be obtained by injection-molding a desired plastic material.

Figure 16A:
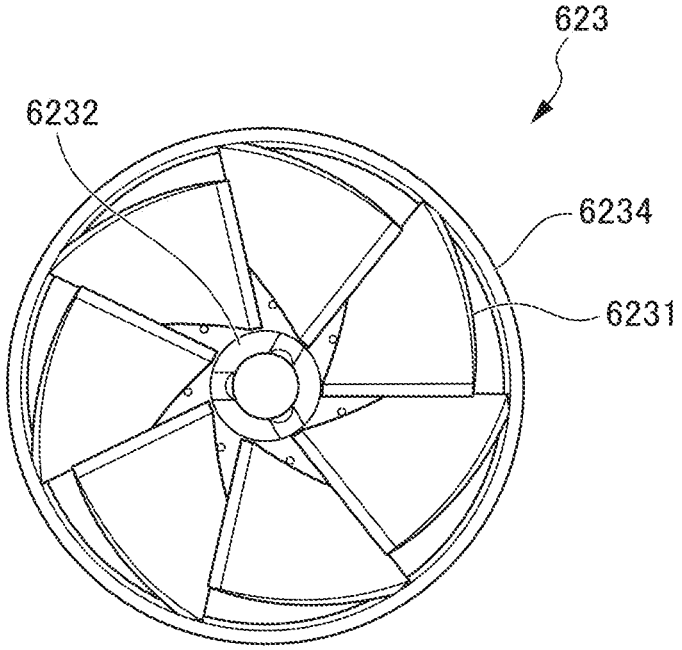
FIG. 16 is a diagram showing a first blade member of the impeller according to the second embodiment, FIG. 16(*a*) is a plan view, FIG. 16(*b*) is a side view and FIG. 16(*c*) is a bottom view.
Figure 16B:
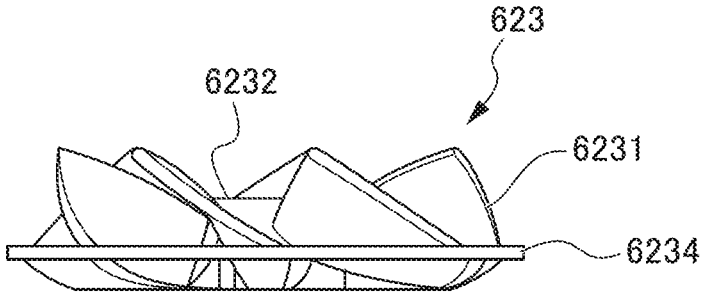
Figure 16C:
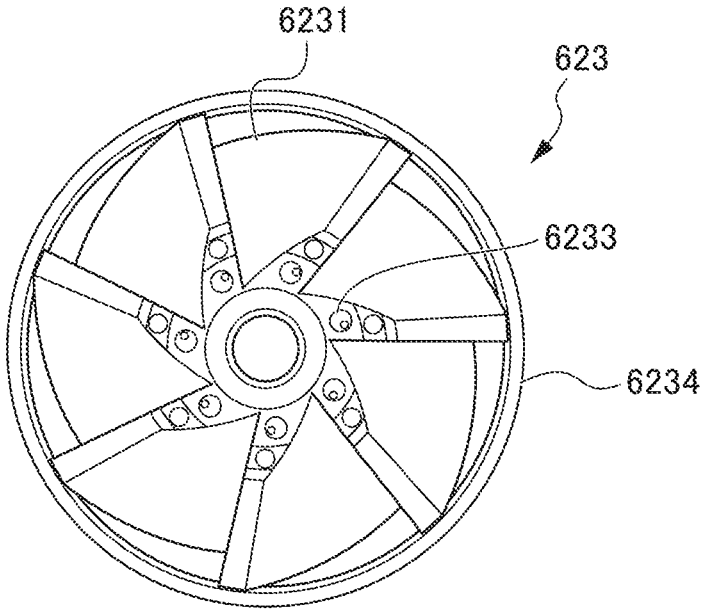

The blade member 62 will then be described in more detail with reference to FIG. 16. FIG. 16 is a diagram showing a first blade member 623 which will be described later, FIG. 16(*a*) is a plan view, FIG. 16(*b*) is a side view and FIG. 16(*c*) is a bottom view.

As shown in FIGS. 12 and 13, the blade member 62 includes the first blade member 623 which is arranged on the front surface side, that is, on the side of the shroud 63 and a second blade member 624 which is arranged on the back surface side. The first blade member 623 includes a front blade 6231 which is arranged on the front side when the impeller 61 is seen from the front surface side, and forms part of the blade 622. The second blade member 624 includes a back blade 6241 which is arranged on the back side as compared with the front blade 6231 when the impeller 61 is seen from the front surface side, and forms at least part of another portion of the blade 622.

Each of the blades 622 is formed with the front blade 6231 and the back blade 6241, and while a blade surface 622*f* is being twisted, the blade 622 is extended out to the outer circumference by drawing a spiral curve inclined with respect to the circumferential direction of the impeller 61 from the base 621.

With the blade surface 623*f* directed forward, the front blade 6231 receives the fluid on the blade surface 623*f*. In the back blade 6241, a blade surface 624*f* continuous from the front blade 6231 is provided to stand substantially vertically with respect to the forward side. Hence, the back blade 6241 (the second blade member 624) includes a flat portion 6242 which is formed on a blade edge. The flat portion 6242 is in surface contact with the flange portion 632.

Each of a plurality of second blade members 624 includes an engagement portion 6243 which is formed on the flat portion 6242. The engagement portion 6243 is protruded straight from the flat portion 6242 of the back blade 6241 (the second blade member 624) to the front surface side. A plurality of engagement portions 6243 are respectively inserted into a plurality of engaged portions 633, and the second blade member 624 is locked to the shroud 63. In the engagement portions 6243 inserted into the engaged portions 633, the tip end is deformed to form a crimp portion 6244, and the second blade member 624 is fixed to the shroud 63. As shown in FIG. 13, in the second blade member 624, a plurality of bars 6245 are formed on the front surface side.

The second blade member 624 can be molded with a mold formed with an upper mold, a lower mold and a plurality of slides (nesting type) which are divided in the circumferential direction sandwiched therebetween. For example, in a boundary region between the upper mold, the lower mold and the slides, a mold having a cavity corresponding to the second blade member 624 is prepared. The parting line of the mold is formed on part of the base 621 and the end portion of the back blade 6241.

With this mold, a desired plastic material is injection-molded. After the molding, the slides of the mold are released radially from between the upper mold and the lower mold, thereafter the upper mold is released upward and the lower mold is released downward, with the result that the second blade member 624 is released from the mold without fail.

As shown in FIG. 16, the first blade member 623 includes a shaft portion 6232 which forms part of the front surface side of the base 621. In the shaft portion 6232, a plurality of holes 6233 are formed through which a plurality of bars 6245 are respectively inserted.

The first blade member 623 includes a protrusion portion 6234 which is protruded to the side of the shroud 63 and which is formed in the shape of a ring. As shown in FIG. 14, the engagement portion 6243 is engaged with the concave portion 634.

The first blade member 623 is integrally formed with the shaft portion 6232 which has a shaft hole in the center portion, a plurality of front blades 6231 which are extended laterally from the outer circumferential surface of the shaft portion 6232 and the protrusion portion 6234. The front blades 6231 are not overlaid on each other when seen from the front surface side and the back surface side (FIGS. 16(*a*) and 16(*c*)).

Since as described above, the front blades 6231 are not overlaid on each other when seen from the front surface side and the back surface side, the first blade member 623 can be molded with a mold formed with an upper mold and a lower mold. For example, a mold is prepared which has a cavity corresponding to the first blade member 623 in a boundary region between the upper mold and the lower mold. The parting line of the mold is formed on the end portion of the front blade 6231 and the protrusion portion 6234.

With this mold, a desired plastic material is injection-molded. After the molding, the upper mold is released upward and the lower mold is released downward, with the result that the first blade member 623 is released from the mold without fail.

With the impeller 61 according to the second embodiment, the following effects are achieved.

(5) In the second embodiment, in the impeller 61 which includes the shroud 63 and in which the blade member 62 includes the first blade member 623 and the second blade member 624, the second blade member 624 sandwiches the first blade member 623 together with the shroud 63.

In this way, it is not necessary to join the first blade member 623 and the second blade member 624. Thus, it is possible to easily manufacture the impeller 61.

(6) In the second embodiment, the first blade member 623 includes the protrusion portion 6234 in which the first blade member 623 is protruded to the side of the shroud 63, and the shroud 63 includes the concave portion 634. Furthermore, the protrusion portion 6234 is engaged with the concave portion 634.

In this way, when the impeller 61 is manufactured, it is possible to easily locate the first blade member 623. The second blade member 624 and the shroud 63 can more stably sandwich the first blade member 623.

(7) In the second embodiment, the protrusion portion 6234 is formed in the shape of a ring.

In this way, when the impeller 61 is manufactured, it is possible to easily locate the first blade member 623.

(8) In the second embodiment, the shroud 63 is formed on the circumferential edge of an end portion on the side of the base 621, and the surface on the side of the base 621 includes the flange portion 632 formed in the shape of a flat surface. The second blade member 624 includes the flat portion 6242 which is in surface contact with the flange portion 632.

In this way, when the impeller 61 is manufactured, the surface on the side of the base 621 of the flange portion 632 and the flat portion 6242 are brought into contact with each other, and thus it is possible to easily locate the second blade member 624.

Although in the second embodiment, the protrusion portion 6234 having the first blade member 623 is formed in the shape of a ring, the present invention is not limited to this configuration.

Figure 17A:
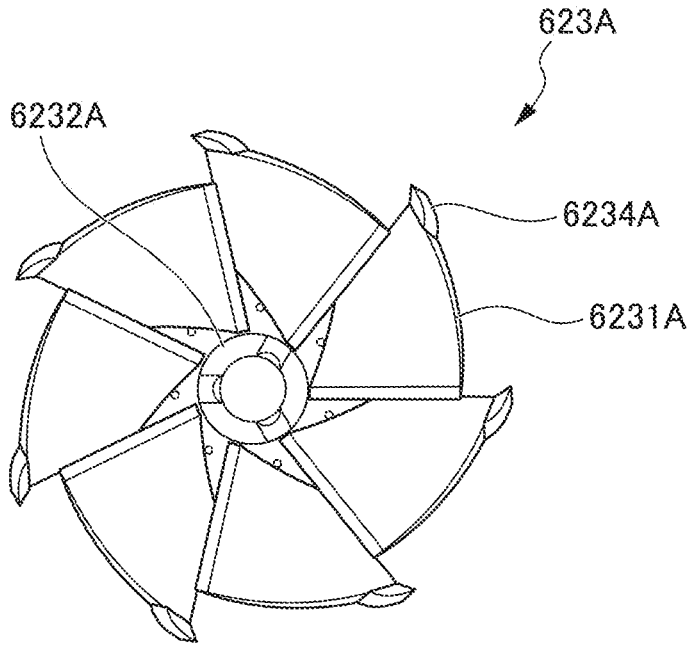
FIG. 17 is a diagram showing a first blade member of an impeller according to a variation of the second embodiment, FIG. 17(*a*) is a plan view, FIG. 17(*b*) is a side view and FIG. 17(*c*) is a bottom view.
Figure 17B:
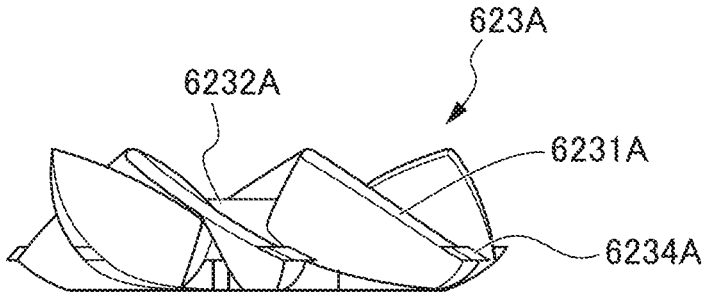
Figure 17C:
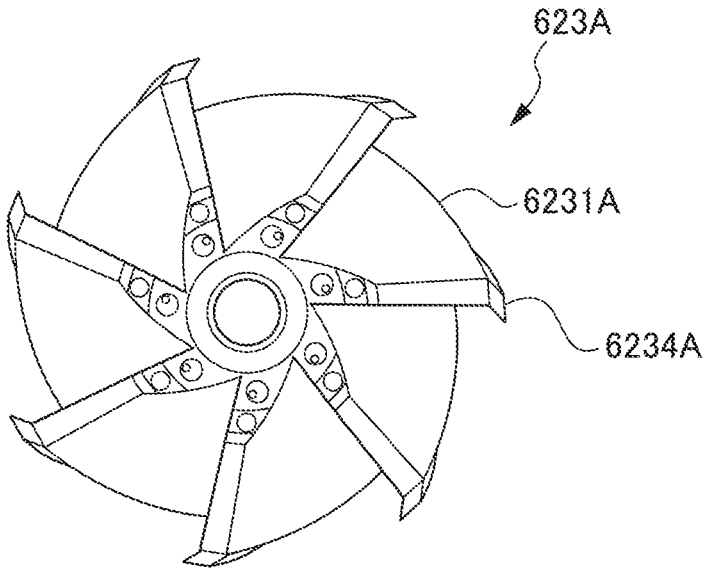

For example, FIG. 17 is a diagram showing a first blade member 623A of an impeller 61A according to a variation of the second embodiment, FIG. 17(*a*) is a plan view, FIG. 17(*b*) is a side view and FIG. 17(*c*) is a bottom view. In the description of the first blade member 623A of the impeller 61A, the same parts as those of the impeller 61 (the first blade member 623) are identified with the same symbols in the figures, and the description thereof will be omitted.

As shown in FIG. 17, the first blade member 623A of the impeller 61A includes a protrusion portion 6234A which is protruded to the side of a shroud 63A. Although the protrusion portion 6234A is not formed in the shape of a ring unlike the protrusion portion 6234 in the impeller 61, and is only protruded to part of the circumferential direction of the impeller 61A, the protrusion portion 6234A is engaged with a concave portion 634A as with the protrusion portion 6234 (see FIG. 14).

Hence, in the impeller 61A, as in the impeller 61, when it is manufactured, it is possible to easily locate the first blade member 623A. A second blade member 624A and the shroud 63A can more stably sandwich the first blade member 623A.

Third Embodiment

Figure 18:
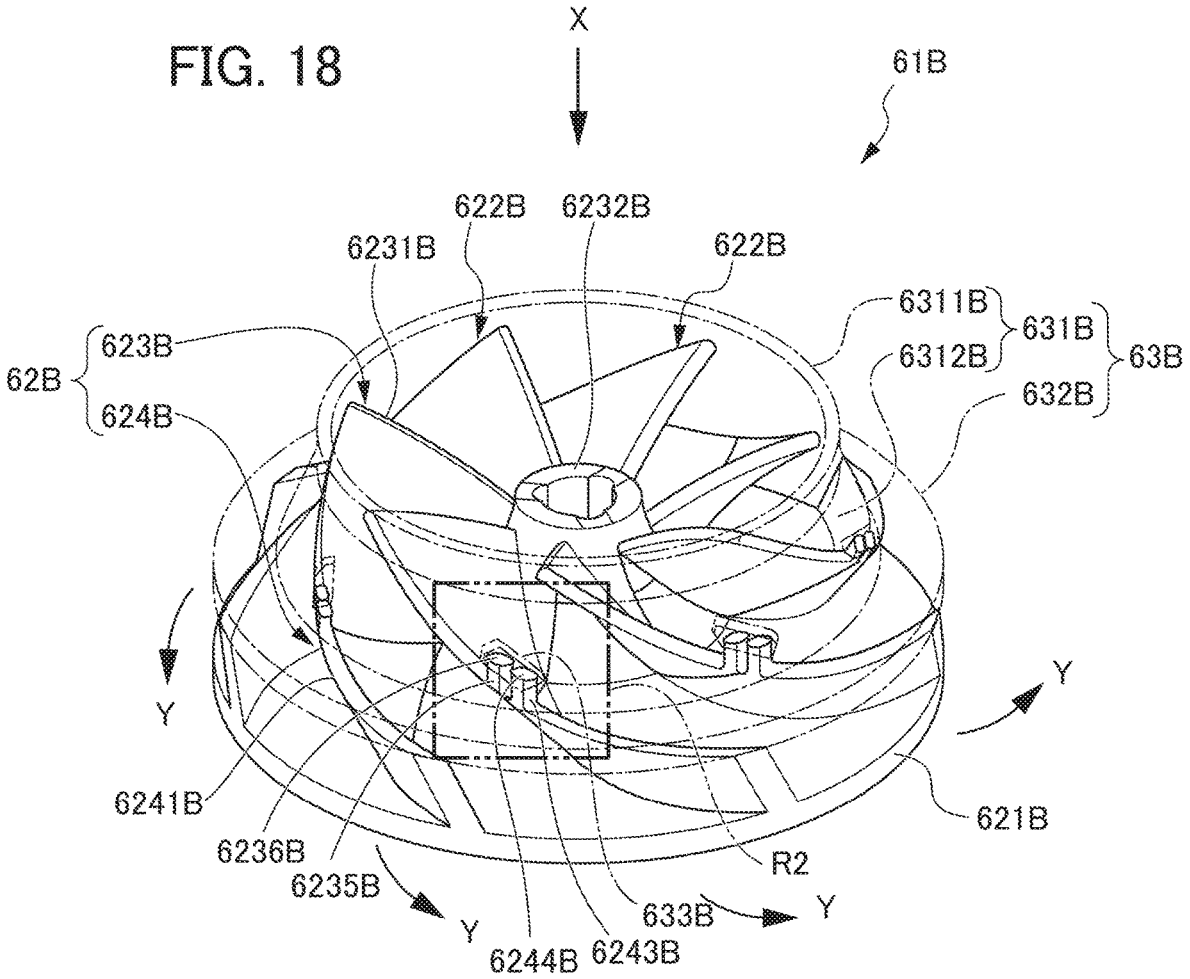
FIG. 18 is a perspective view showing an impeller according to a third embodiment.
Figure 19:
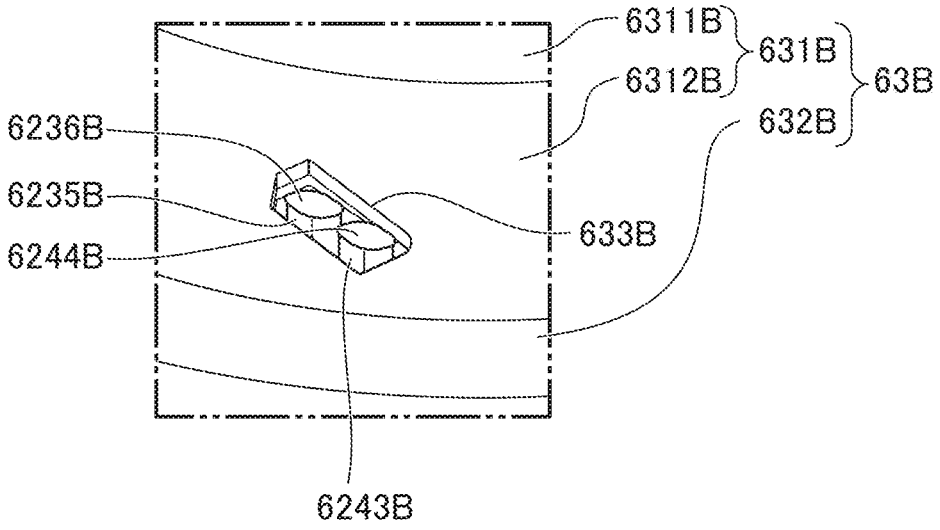
FIG. 19 is a perspective view showing the impeller according to the third embodiment and is an enlarged view of a main portion in FIG. 18.

An impeller 61B according to a third embodiment of the present invention will then be described. In the description of the impeller 61B, the same parts as those of the impeller 61 are identified with the same symbols in the figures, and the description thereof will be omitted. FIG. 18 is a perspective view showing the impeller 61B according to the third embodiment of the present invention. FIG. 19 is a perspective view showing the impeller 61B and is an enlarged view of a main portion R2 in FIG. 18.

The impeller 61B mainly differs from the impeller 61 in a position where a second engagement portion 6243B (the engagement portion 6243) included in a second blade member 624B is formed and in that a first blade member 623B includes an engagement portion.

A shroud 63B included in the impeller 61B has not a flange portion 632B but a plurality of engaged portions 633B formed in a main body portion 631B. Specifically, the engaged portion 633B is formed in an inclination portion 6312B. The engaged portion 633B is formed in the shape of a hole extended in the axial direction of the impeller 61B.

The first blade member 623B includes a plurality of first engagement portions 6235B which are formed on the side of the shroud 63B and which serve as the engagement portions. The first engagement portion 6235B is protruded from the end portion on the outer circumferential side of the first blade member 623B, that is, the tip end on the outer circumferential side of a front blade 6231B straight to the front surface side.

The second blade member 624B includes a plurality of second engagement portions 6243B which are formed on the side of the shroud 63B and which serve as the engagement portions. The second engagement portion 6243B is protruded from the tip end on the front surface side of the second blade member 624B (back blade 6241B) straight to the front surface side.

The first engagement portion 6235B and the second engagement portion 6243B are adjacent to each other, and the first engagement portion 6235B and the second engagement portion 6243B adjacent to each other are engaged with the same engaged portion 633B. In the first engagement portion 6235B and the second engagement portion 6243B inserted into the engaged portion 633B, the tip ends thereof are deformed to respectively form crimp portions 6236B and 6244B, and the first blade member 623B and the second blade member 624B are fixed to the shroud 63B.

With the impeller 61B according to the third embodiment, in addition to the effects (5) and (8) described above, the following effects are achieved.

(9) In the third embodiment, the first blade member 623B and the second blade member 624B respectively have the first engagement portion 6235B and the second engagement portion 6243B formed on the side of the shroud 63B, and the shroud 63B has the engaged portion 633B with which the first engagement portion 6235B and the second engagement portion 6243B are engaged.

In this way, when the impeller 61B is manufactured, it is possible to easily locate the shroud 63B with respect to a blade member 62B (the first blade member 623B and the second blade member 624B).

(10) In the third embodiment, the first engagement portion 6235B and the second engagement portion 6243B are adjacent to each other.

In this way, with one engaged portion 633B, it is possible to integrate the three members, that is, the first blade member 623B, the second blade member 624B and the shroud 63B, with the result that it is easier to manufacture the impeller 61B.

Although in the third embodiment, the engaged portion 633B is formed in the shape of a hole, the present invention is not limited to this configuration.

Figure 20:
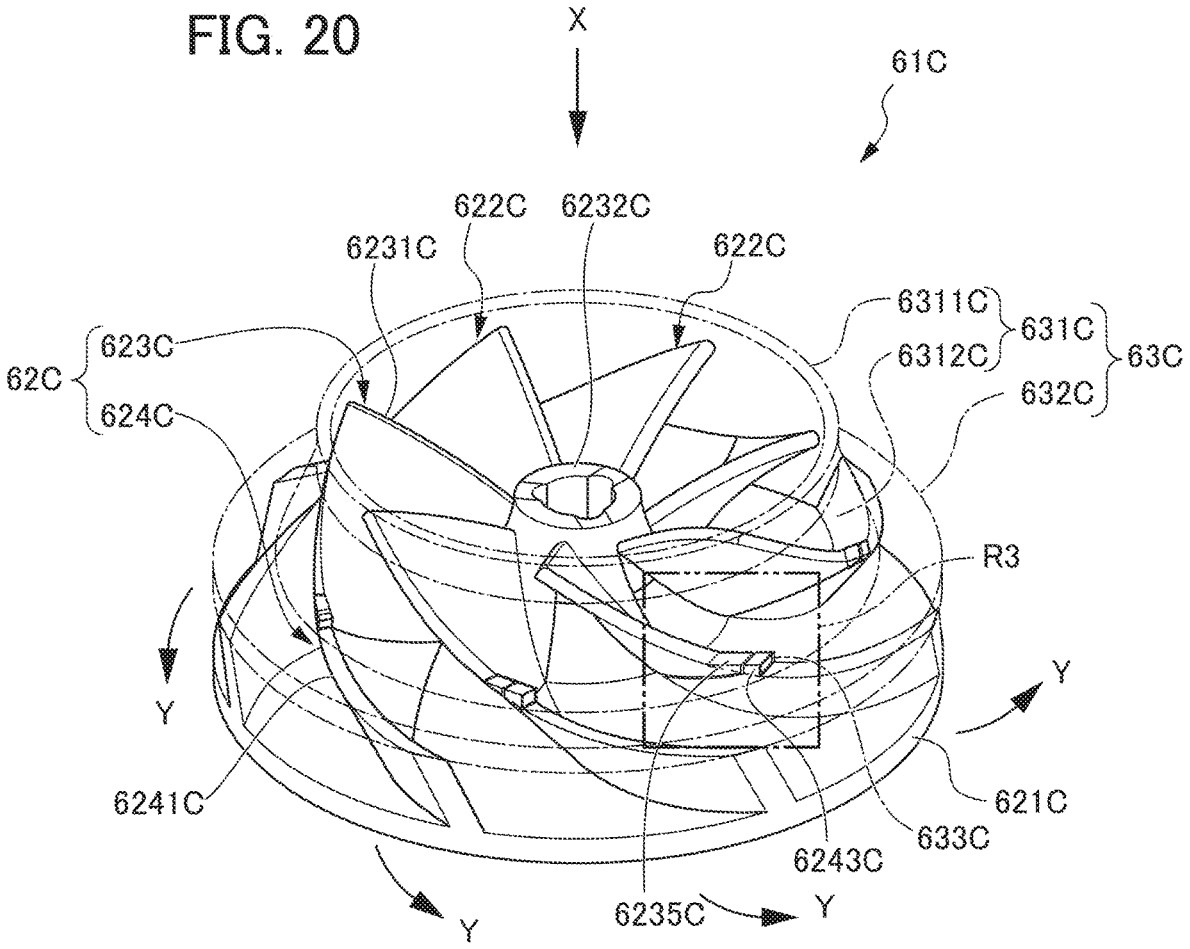
FIG. 20 is a perspective view showing an impeller according to a variation of the third embodiment.
Figure 21:
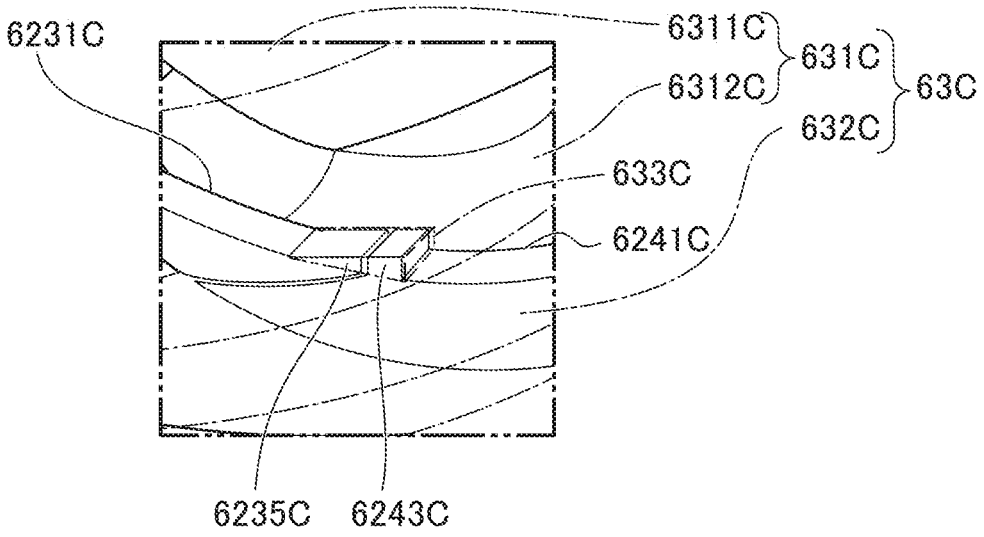
FIG. 21 is a perspective view showing the impeller according to the variation of the third embodiment and is an enlarged view of a main portion in FIG. 20.

For example, FIG. 20 is a perspective view showing an impeller 61C according to a variation of the third embodiment. FIG. 21 is a perspective view showing the impeller 61C and is an enlarged view of a main portion R3 in FIG. 20. In the description of the impeller 61C, the same parts as those of the impeller 61B are identified with the same symbols in the figures, and the description thereof will be omitted.

As shown in FIGS. 20 and 21, a shroud 63C which includes the impeller 61C including a plurality of engaged portions 633C formed in a main body portion 631C. Specifically, the engaged portion 633C is formed on the inner surface side of an inclination portion 6312C as a concave portion cut out into the shape of a triangular prism, and is not penetrated to the outer side surface of the shroud 63C.

A plurality of first engagement portions 6235C of a first blade member 623C are protruded from the outer circumferential side end portion of the first blade member 623C, that is, the tip end on the outer circumferential side of the front blade 6231.

A plurality of second engagement portions 6243C of a second blade member 624C are protruded from the tip end on the front surface side of the second blade member 624C (back blade 6241C).

A surface on the front surface side of the first engagement portion 6235C and a surface on the front surface side of the second engagement portion 6243C are formed so as to be substantially flush with each other. The first engagement portion 6235C and the second engagement portion 6243C are adjacent to each other, and the outer side surfaces of the first engagement portion 6235C and the second engagement portion 6243C are formed in a shape corresponding to the inner side surface of the engaged portion 633C.

The first engagement portion 6235C and the second engagement portion 6243C engaged with the engaged portion 633C are welded by ultrasound to the inner surface of the engaged portion 633C by making an ultrasonic welding machine approach from the outer surface side of the shroud 63C.

Hence, as with the impeller 61B, when the impeller 61C is manufactured, it is possible to easily locate the shroud 63C. Since the first engagement portion 6235C and the second engagement portion 6243C are adjacent to each other and are engaged with the same engaged portion 633C, the impeller 61C is easily manufactured.

Although the second embodiment and the third embodiment of the present invention are described above, it is needless to say that various variations and modifications are possible without departing from the spirit of the present invention.

Fourth Embodiment

The configuration of an impeller 71 according to a fourth embodiment of the present invention will be described.

Figure 22:
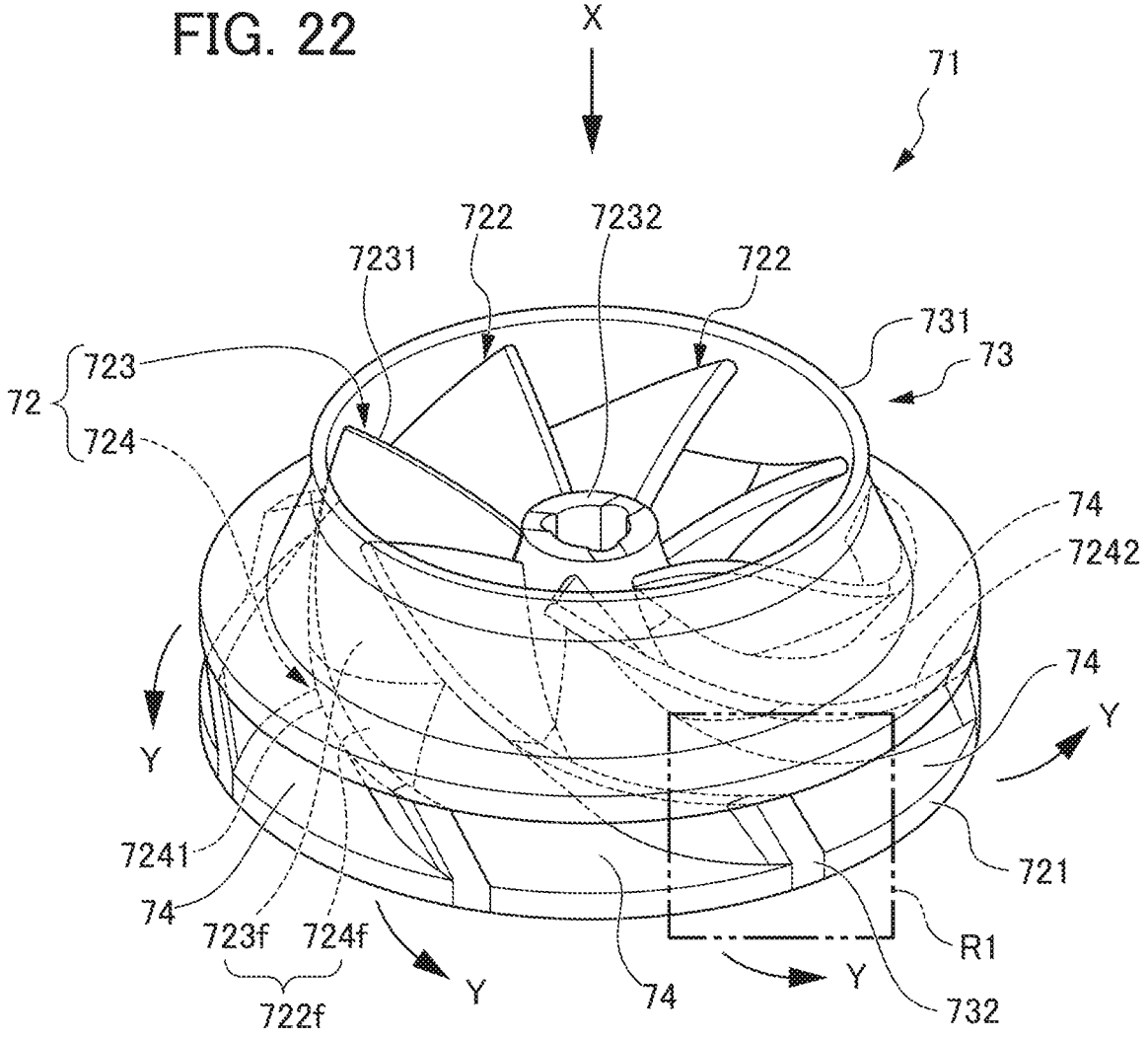
FIG. 22 is a perspective view showing an impeller according to a fourth embodiment.
Figure 23:
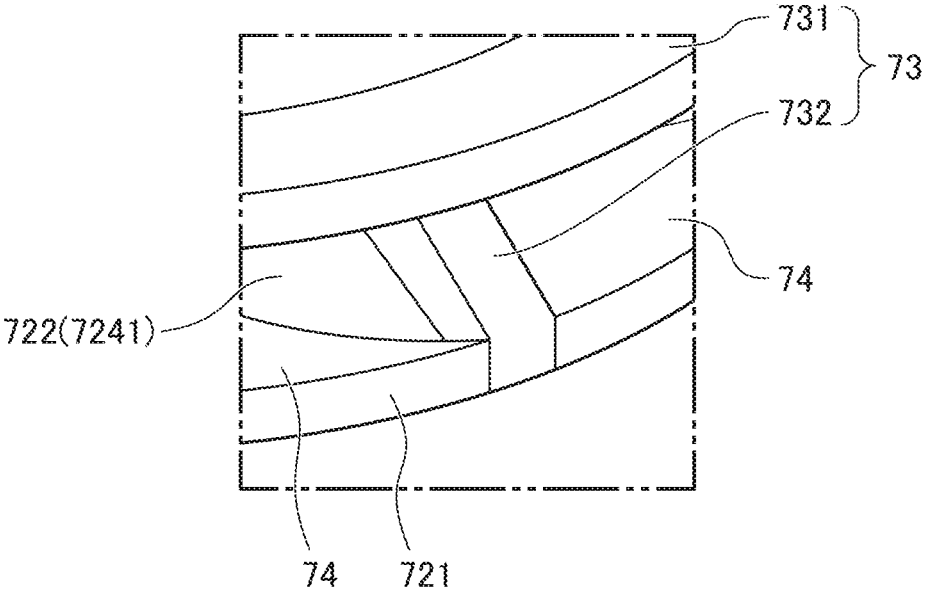
FIG. 23 is a perspective view showing the impeller according to the fourth embodiment and is an enlarged view of a main portion in FIG. 22.
Figure 24:
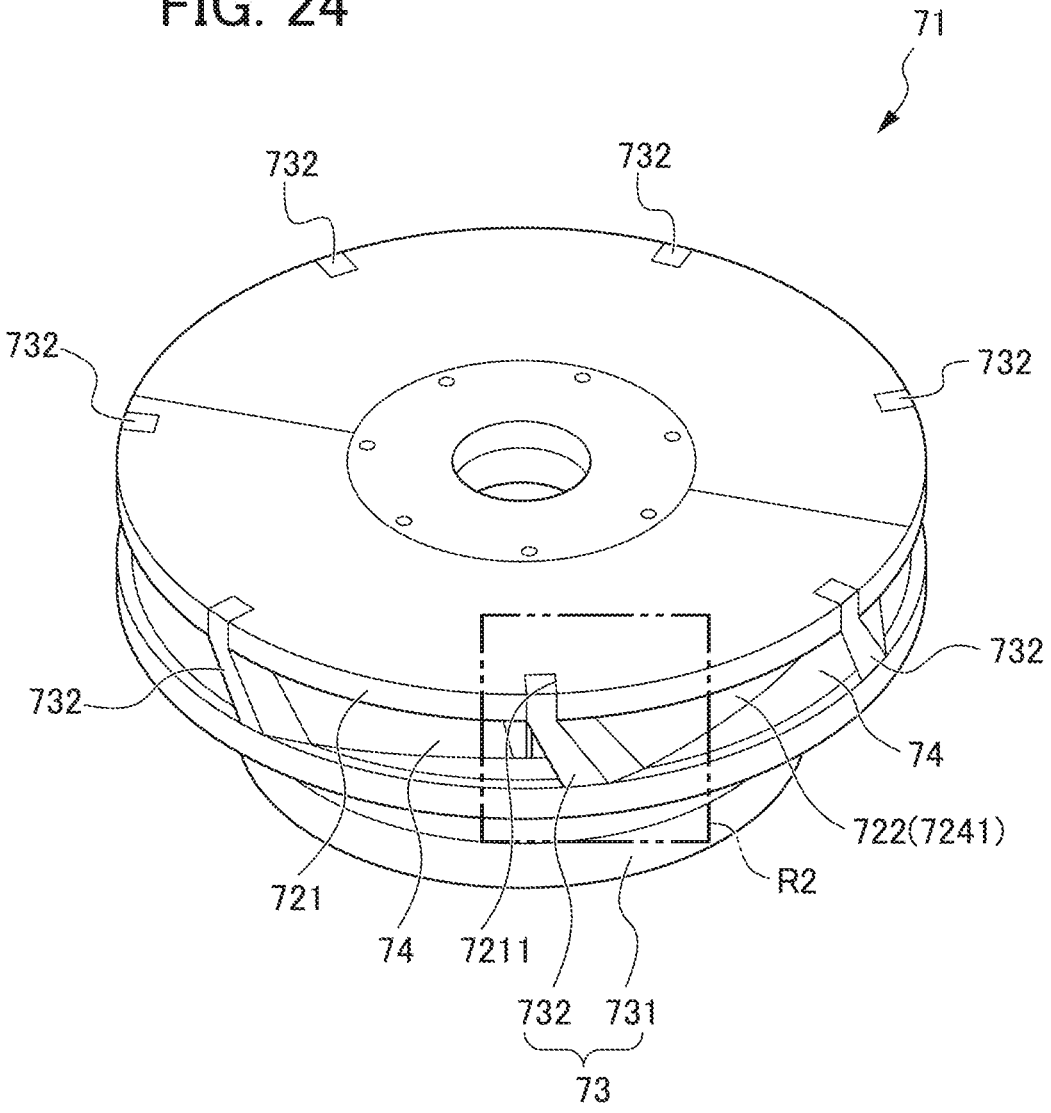
FIG. 24 is a perspective view showing the impeller according to the fourth embodiment and is a perspective view when seen from a back surface side.
Figure 25:
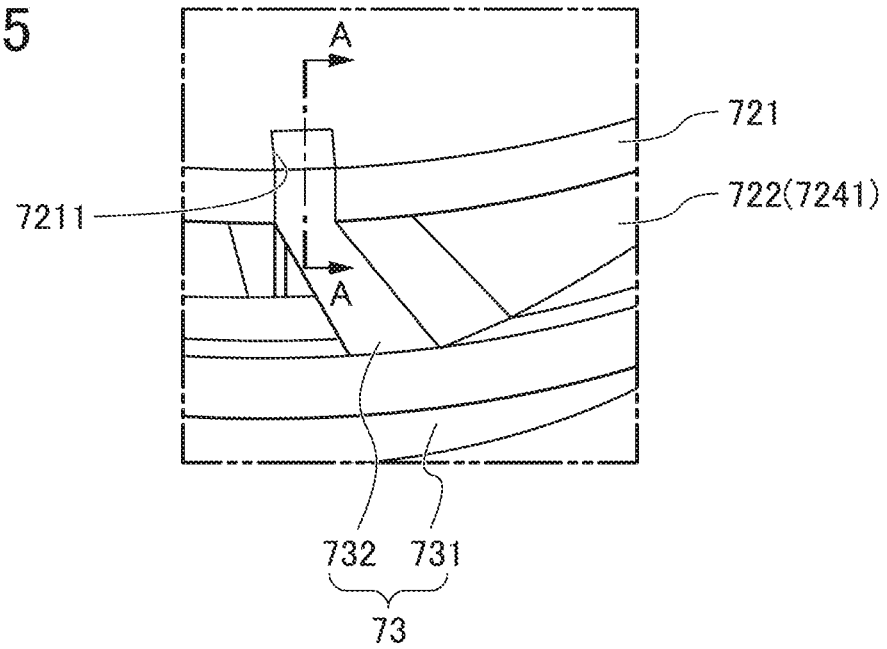
FIG. 25 is a perspective view showing the impeller according to the fourth embodiment and is an enlarged view of a main portion in FIG. 24.

FIG. 22 is a perspective view showing the impeller 71 according to the fourth embodiment of the present invention. FIG. 23 is a perspective view showing the impeller 71 and is an enlarged view of a main portion R1 in FIG. 22. FIG. 24 is a perspective view showing the impeller 71 and is a perspective view when the impeller 71 is seen from a back surface side. FIG. 25 is a perspective view showing the impeller 71 and is an enlarged view of a main portion R2 in FIG. 24.

The impeller 71 is used in, for example, a compressor or a water pump. The impeller 71 is arranged within a tubular member which passes the fluid, and is rotated by the drive of a motor to pressurize the fluid.

As shown in FIG. 22, the fluid flows into the impeller 71 from a direction indicated by an arrow X in the figure to the center side of the front surface of a plurality of blades 722 which will be described later. The fluid flowing thereinto is pressurized by the blades 722 which are rotated by the drive of the motor and the pressurized fluid is discharged, in a direction indicated by an arrow Y in the figure, that is, radially from the outer circumferential portion of the impeller 71. In the present specification, the side (base end side indicated by the arrow X in FIG. 22) where the fluid of the impeller 71 flows in is referred to as the front surface and the opposite side (tip end side indicated by the arrow X in FIG. 22) is referred to as the back surface.

As shown in FIG. 22, the impeller 71 includes a blade member 72 and a shroud 73. The blade member 72 includes a base 721 and a plurality of blades 722 arranged on the base 721. The base 721 is formed such that the base 721 is arranged on the back surface side and that the center portion on the front surface side bulges. The blade 722 is fixed to the base 721, and is extended out to the outer circumferential side. The blade member 72 is shaped such that the blade member 72 alone cannot be released from an integrated mold at a time.

As shown in FIGS. 24 and 25, the base 721 is formed in the shape of a circle when seen from the back surface side. Since a connector portion 732 which will be described later is engaged with the base 721, the base 721 has a plurality of concave portions 7211 at an outer circumferential end portion.

The blade member 72 includes a first blade member 723 which is arranged on the front surface side, that is, on the side of the shroud 73 and a second blade member 724 which is arranged on the back surface side. The first blade member 723 includes a front blade 7231 which is arranged on the front side when the impeller 71 is seen from the front surface side, and forms part of the blade 722. The second blade member 724 includes a back blade 7241 which is arranged on the back side as compared with the front blade 7231 when the impeller 71 is seen from the front surface side, and forms at least part of another part of the blade 622.

Each of the blades 722 is formed with the front blade 7231 and the back blade 7241, and while a blade surface 722*f* is being twisted, the blade 722 is extended out to the outer circumference by drawing a spiral curve inclined with respect to the circumferential direction of the impeller 71 from the base 721.

With the blade surface 723*f* directed forward, the front blade 7231 receives the fluid on the blade surface 723*f*. In the back blade 7241, a blade surface 724*f* continuous from the front blade 7231 is provided to stand substantially vertically with respect to the forward side. Hence, the back blade 7241 (the second blade member 724) includes a flat portion 7242 which is formed on a blade edge. The flat portion 7242 is in surface contact with a flange portion 7312.

The second blade member 724 can be molded with a mold formed with an upper mold, a lower mold and a plurality of slides (nesting type) which are divided in the circumferential direction sandwiched therebetween. For example, in a boundary region between the upper mold, the lower mold and the slides, a mold having a cavity corresponding to the second blade member 724 is prepared. The parting line of the mold is formed on part of the base 721 and the end portion of the back blade 7241.

With this mold, a desired plastic material is injection-molded. After the molding, the slides of the mold are released radially from between the upper mold and the lower mold, thereafter the upper mold is released upward and the lower mold is released downward, with the result that the second blade member 724 is released from the mold without fail.

As shown in FIG. 22, the first blade member 723 includes a shaft portion 7232 which forms part of the front surface side of the base 721. The first blade member 723 is integrally formed with the shaft portion 7232 which has a shaft hole in the center portion and a plurality of front blades 7231 which are extended laterally from the outer circumferential surface of the shaft portion 7232. The front blades 7231 are not overlaid on each other when seen from the front surface side and the back surface side (FIGS. 26(*a*) and 26(*c*)).

Since as described above, the front blades 7231 are not overlaid on each other when seen from the front surface side and the back surface side, the first blade member 723 can be molded with a mold formed with an upper mold and a lower mold. For example, a mold is prepared which has a cavity corresponding to the first blade member 723 in a boundary region between the upper mold and the lower mold. The parting line of the mold is formed on the end portion of the front blade 7231.

With this mold, a desired plastic material is injection-molded. After the molding, the upper mold is released upward and the lower mold is released downward, with the result that the first blade member 723 is released from the mold without fail.

The shroud 73 is arranged on the front surface side opposite the base 721 through the blades 722. The shroud 73 is arranged on the outer circumferential side of the blades 722 to cover the blades 722. Between the shroud 73 and the base 721, a flow path 74 is formed which is partitioned by a plurality of blades. The flow path 74 is partitioned by a plurality of blades 722.

The shroud 73 includes a shroud main body portion 731 and a plurality of connector portions 732 which are extended to the side of the base 721 from an end portion on the side of the base 721 of the shroud main body portion 731 to straddle the flow path 74 and which are engaged with the base 721. The shroud main body portion 731 includes a cylindrical portion 7311 which is formed in the shape of a cylinder and a flange portion 7312 which is formed on the circumferential edge of the end portion on the side of the base 721 of the cylindrical portion 7311. The connector portions 732 are protruded from the back surface side of the outer circumferential end portion of the flange portion. The shroud 73 can be obtained by, for example, heating and welding the shroud main body portion 731 and the connector portions 732 which are separately molded. The shroud main body portion 731 and the connector portions 732 can be obtained by injection-molding a desired plastic material.

The connector portion 732 is arranged on an extension line in a direction extending to the outer circumferential side of the blade 722. In this way, the connector portion 732 forms part of the blade 722. A thickness when seen from the outer circumferential side of the connector portion 732 is equal to that of the blade 722. More specifically, the side surface of the connector portion 732 extending in the radial direction of the shroud 73 and the blade surfaces on both sides of the blade 722 are formed so as to be substantially flush with each other.

As shown in FIGS. 24 and 25, the connector portion 732 is engaged with the base 721 so as to fill the concave portion 7211. The surface on the back surface side of the connector portion 732 and the surface on the back surface side of the base 721 are substantially flush with each other. The connector portions 732 are arranged so as to correspond to all the blades 722.

Figure 26:
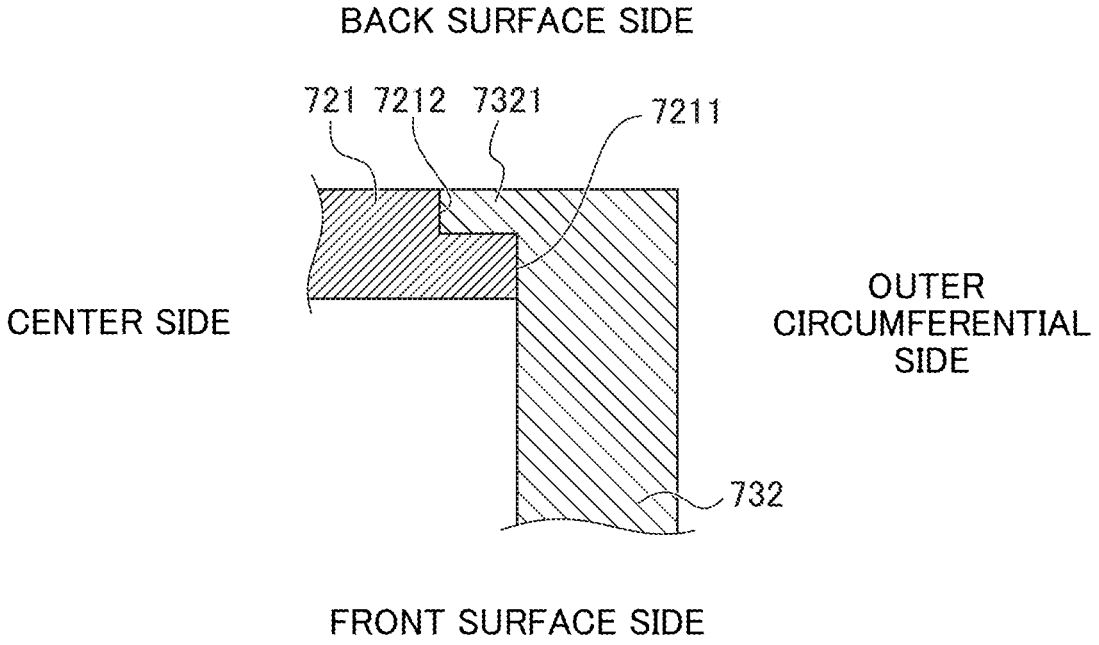
FIG. 26 is a cross-sectional view showing the impeller according to the fourth embodiment and is an enlarged cross-sectional view taken along line A-A of FIG. 25.

FIG. 26 is an enlarged cross-sectional view taken along line A-A of FIG. 25.

As shown in FIG. 26, the connector portion 732 has, at its tip end, a nail portion 7321 which is locked to the base 721. The base 721 has an engaged portion 7212 formed on the back surface side on the center side of the concave portion 7211. The connector portion 732 is formed of a plastic material which is flexible and which can be elastically deformed. When the shroud 73 is coupled to the blade member 72, the connector portion 732 is first elastically deformed to the outer circumferential side and is inserted into the concave portion 7211 formed in the base 721. Then, the shape of the connector portion 732 which is curved by being elastically deformed is returned to its original state, and thus the nail portion 7321 is engaged with the engaged portion 7212 of the base 721, with the result that the shroud 73 is coupled to the blade member 72. Here, the nail portion 7321 is engaged with the engaged portion 7212, and thus it is possible to prevent the shroud 73 from being removed from the blade member 72.

With the impeller 71 according to the fourth embodiment, the following effects are achieved.

(11) In the fourth embodiment, in the impeller 71 including the shroud 73, the shroud 73 includes a plurality of connector portions 732 which are extended to the side of the base 721 from the end portion on the side of the base 721 of the shroud main body portion 731 to straddle the flow path 74 formed between the shroud 73 and the base 721 and which are engaged with the base 721.

In this way, the connector portion 732 is only engaged with the base 721, and thus it is possible to couple the shroud 73 and the blade member 72, with the result that the impeller 71 is easily manufactured. Since the connector portion 732 straddles the flow path 74, the connector portion 732 is formed so as to have a sufficient length. Hence, when the connector portion 732 is engaged with the base 721, the connector portion 732 can be curved by being elastically deformed, with the result that it is also possible to prevent the shroud from being broken.

(12) In the fourth embodiment, the connector portion 732 is arranged on the extension line in the direction extending to the outer circumferential side of the blade 722.

In this way, since the connector portion 732 is prevented from interfering with the fluid passing through the impeller 71, the efficiency when the impeller 71 is used is enhanced.

(13) In the fourth embodiment, the thickness when seen from the outer circumferential side of the connector portion 732 is equal to that of the blade 722.

In this way, the connector portion 732 is not extended to the flow path 74, and is prevented from interfering with the fluid passing through the impeller 71, and thus the efficiency when the impeller 71 is used is enhanced. The thickness when seen from the outer circumferential side of the connector portion 732 is less than that of the blade 722, and thus it is also possible to obtain the same effect.

(14) In the fourth embodiment, the connector portions 732 are arranged so as to correspond to all the blades 722. In this way, it is possible to disperse a force applied to the connector portion 732, with the result that the strength of the impeller 71 is enhanced.

(15) In the fourth embodiment, the connector portion 732 has, at its tip end, the nail portion 7321 which is locked to the base 721.

In this way, it is possible to more easily couple the shroud 73 and the blade member 72. The shroud 73 is unlikely to be removed from the blade member 72, and thus the strength of the impeller 71 is more enhanced.

The present invention is not limited to the fourth embodiment of the present invention, and as long as it is possible to achieve the object of the present invention, variations, modifications and the like are included in the present invention.

Although in the fourth embodiment, the blade member 72 is formed with the two members, that is, the first blade member 723 and the second blade member 724, there is no limitation on this configuration, and the blade member 72 may be formed with a single member.

EXPLANATION OF REFERENCE NUMERALS

1: impeller
3: shroud
21: base (main plate)
22: shaft portion (rotation shaft)
24: flat surface (outer circumferential end portion)
25: protrusion
25*a*: longitudinal width (width direction)
33: flat portion
34: through hole
35: concave portion
35*a*: longitudinal width (width direction)
O2: opening diameter
61, 61A, 61B, 61C: impeller
62, 62A, 62B, 62C: blade member
621, 621A, 621B, 621C: base
622, 622A, 622B, 622C: blade
623, 623A, 623B, 623C: first blade member
6234, 6234A: protrusion portion
6235B, 6235C: first engagement portion
624, 624A, 624B, 624C: second blade member
6243B, 6243C: second engagement portion
63, 63A, 63B, 63C: shroud
632, 632A, 632B, 632C: flange portion
633B, 633C: engaged portion
634, 634A: concave portion
71: impeller
721: base
722: blade
73: shroud
731: shroud main body portion
732: connector portion
7321: nail portion
74: flow path

The invention claimed is:

1. An impeller comprising:

a blade arranged on a main plate; and a shroud which is arranged on the blade opposite the main plate and, wherein the shroud has a curved shape, wherein the shroud includes a flat portion on an outer circumferential portion of the shroud, and an outer circumferential end portion of the blade and the flat portion of the shroud are joined, wherein a protrusion is provided on the outer circumferential end portion of the blade, a quadrangular-shaped through hole is provided in the flat portion of the shroud, and a quadranqular-shaped concave portion surrounding the through hole is provided in the flat portion of the shroud, a direction of a width of the concave portion coinciding with a direction of a circumference along a curve of the blade, and the through hole having a width that is inclined relative to the width of the concave portion on a plane of the flat portion of the shroud, the outer circumferential end portion of the blade and the flat portion of the shroud are joined by inserting the protrusion through the through hole, and then deforming a tip end of the protrusion to have a larger diameter than an opening diameter of the through hole, and before deforming the tip end of the protrusion, a direction of a width of the protrusion, including the tip end of the protrusion, is inclined with respect to the direction of the circumference along the curve of the blade extended out and coincides with a curve direction of the blade, the protrusion is inclined in alignment with the through hole, and the deforming of the tip end of the protrusion causes a direction of a width of the tip end of the protrusion to coincide with the direction of the circumference along the curve of the blade.

* * * * *